United States Patent [19]

Yamaguchi et al.

[11] Patent Number: 4,988,300

[45] Date of Patent: Jan. 29, 1991

[54] RIDING SIMULATOR

[75] Inventors: Masaaki Yamaguchi; Masashi Kito, both of Nagoya; Nobuhiro Iguchi, Tokyo; Shinzo Yoshida, Chigasaki; Atushi Ishigure, Nagoya, all of Japan

[73] Assignee: Meitec Corporation, Nagoya, Japan

[21] Appl. No.: 448,356

[22] Filed: Dec. 11, 1989

[30] Foreign Application Priority Data

| | | | |
|---|---|---|---|
| Dec. 15, 1988 | [JP] | Japan | 63-317160 |
| Dec. 21, 1988 | [JP] | Japan | 63-322906 |
| Jan. 17, 1989 | [JP] | Japan | 1-9567 |
| Jan. 25, 1989 | [JP] | Japan | 1-15690 |
| Feb. 16, 1989 | [JP] | Japan | 1-36570 |
| Mar. 3, 1989 | [JP] | Japan | 1-52208 |
| Mar. 4, 1989 | [JP] | Japan | 1-52449 |

[51] Int. Cl.[5] ..... A63B 69/00; G09B 9/00

[52] U.S. Cl. ..... 434/247; 434/365; 272/53.1; 272/53.2; 272/93; 364/578; 280/1.201

[58] Field of Search ..... 634/225, 247, 258, 308, 634/365, 578; 272/1 D, 3–5, 52, 52.5, 53.1, 53.2, 93, 129, 902; 280/1.201, 1.206, 1.207

[56] References Cited

U.S. PATENT DOCUMENTS

| | | | |
|---|---|---|---|
| 491,927 | 2/1893 | Rugg | 272/53.2 |
| 2,195,824 | 10/1939 | Ochoa | 280/1.201 |
| 4,713,010 | 12/1987 | Veillas | 434/247 |
| 4,906,012 | 3/1990 | Wang | 280/1.206 X |

FOREIGN PATENT DOCUMENTS

| | | | |
|---|---|---|---|
| 1019069 | 4/1953 | France | 272/53.1 |
| 1301420 | 4/1987 | U.S.S.R. | 434/247 |

*Primary Examiner*—Richard J. Apley
*Assistant Examiner*—Joe H. Cheng
*Attorney, Agent, or Firm*—Dennison, Meserole, Pollack & Scheiner

[57] ABSTRACT

A riding simulator whrein the basic stepping actions of a real horse is closely simulated. The riding simulator includes an artificial horse body, horse body supporting structures for circularly movably supporting the lower ends of forelegs and hind legs of the horse body, swing adjusting devices for driving the horse body supporting structures and for moving the horse body in both vertical and longitudinal directions, and phase adjusting devices for adjusting the phase difference between the vertical motion and the longitudinal motion of the horse body when the horse body supporting structures are driven. The riding simulator also includes provision for enabling the rider to give aids to the horse body so that the basic stepping actions of a real horse can be simulated.

6 Claims, 22 Drawing Sheets

RIDING SIMULATOR

BACKGROUND OF THE INVENTION

1. Field of the Invention

The present invention relates to a riding simulator of the type including an artificial horse body which can closely simulate the basic stepping actions of a real horse.

2. Description of the Prior Art

Conventionally, riding machines using artificial horse bodies have been commercially available for amusement as used in merry-go-rounds in amusement parks. As will be easily found on riding of such a riding machine, it is quite different in movement from a real horse. More specifically, in the above prior art riding machines, some carry out a complicated movement of the artificial horse body comprising a circular motion which is the synchronous combination of a vertical motion and a longitudinal motion, while most of them are limited to a linear motion only in a vertical or longitudinal direction. Even in the riding machine capable of a circular motion, to say nothing of the one limited only to a linear motion, the length of swing (i.e. the radius of the circular motion) is fixed, and no phase difference between the vertical motion and the longitudinal motion has been taken into consideration. Only the rotational speed of a driving motor for driving the horse body has been designed to be manually controlled so as to increase a feeling of speed-up.

Furthermore, in such a prior art riding machine, the rider cannot give any aids to the horse body. More specifically, it is impossible for the rider to control the horse body by giving signs to the abdomen of the horse body through his legs or to the head of the horse body through reins so as to start the horse body, change the gait, or stop the horse body.

In actual riding, however, there are three kinds of gaits: walk, trot and canter. The gaits are different from each other in the number and length of swing and in phase difference between the vertical motion and longitudinal motion of the horse body. Thus, in order to obtain a riding feeling close to the riding on a real horse, it is necessary to drive the horse body at the number and length of swing and the phase difference commensurate with each gait and to permit control of the horse body such as for starting, change of gaits and stopping thereof by aids given through legs of the rider or reins.

It can be said that the prior art riding machine is used just as a playing machine and never has such functions as to provide a real riding feeling.

In these years, there is a tendency of increasing the number of people who want to acquire riding technique. If a beginner of riding rides on a real horse, his riding posture and aids through shift of his weight are incorrect and unstable at first. This may cause disorder of training of the real horse or increase stress of the real horse, so that, in some cases, the real horse may turn restive, causing a fall of the rider therefrom. This has been a significant difficulty for beginners to acquire proper riding technique.

However, the movement of the prior art riding machine is quite different from the stepping action of a real horse, as described above, so that such a prior art riding machine cannot be used for training of riding. Therefore, it has been long desired to provide an artificial horse body which can closely simulate the stepping action of a real horse so as to permit proper and ready acquirement of the riding technique.

SUMMARY OF THE INVENTION

It is, accordingly, an object of the present invention to provide a riding simulator of the type including an artificial horse body which can closely simulate the motions of a real horse and which can be controlled by aids such as the rider's legs and the rider's hands which control the rein.

It is another object of the present invention to provide a riding training machine which is safe in use and which may enable the trainee to acquire riding techniques in an effective manner.

It is a further object of the present invention to provide a riding machine for amusement which is safe in use and which may provide quite comfortable riding feeling.

It is a still further object of the present invention to provide a riding machine for fitness which may give comfortable riding feeling to the user and which may increase consumption of calories of the user by causing hard motion such as canter of the horse body.

According to the present invention, there is provided a riding simulator which comprises an artificial horse body including a barrel on which a rider can ride, a neck pivotally mounted on the barrel, a head pivotally mounted on the neck and having a rein attached thereto, a saddle mounted on a back of the barrel and having stirrups attached thereto, a right and a left foreleg pivotally mounted on the barrel, and a right and a left hind leg pivotally mounted on the barrel; first horse body supporting structures for circularly movably supporting the lower ends of the right and left forelegs of the horse body and for pivotally supporting the coupling points of the upper ends of the right and left forelegs with the barrel of the horse body; second horse body supporting structures for circularly movably supporting the lower ends of the right and left hind legs of the horse body with the same ends held in a horizontal plane and for pivotally supporting the coupling points of the upper ends of the right and left hind legs with the barrel of the horse body; swing adjusting devices for driving the first and second horse body supporting structures and for moving the horse body in both vertical and longitudinal directions; phase adjusting devices for adjusting the phase difference between the vertical motion and the longitudinal motion of the horse body when the first and second horse body supporting structures are driven to move the horse body in vertical and longitudinal directions; drive force transmitting mechanisms for transmitting drive force to the swing adjusting devices through the phase adjusting devices; main motors for outputting the drive force to the drive force transmitting mechanisms; a control unit for supplying drive power to the main motors for adjusting the rotational speed of the main motors and for outputting electric power to the phase adjusting devices for adjusting the phase of the phase adjusting devices; and means for setting modes of stepping motions corresponding to a plurality of basic stepping motions of the horse body based on the swing produced by the swing adjusting devices, the phase difference produced by the phase adjusting devices and the rotational speed of the main motors, and for outputting setting signals indicative of the set modes to the control unit.

The present invention will become more fully apparent from the claims and description as it proceeds in connection with the drawings.

DETAILED DESCRIPTION OF THE PREFERRED EMBODIMENT

Figure 1:
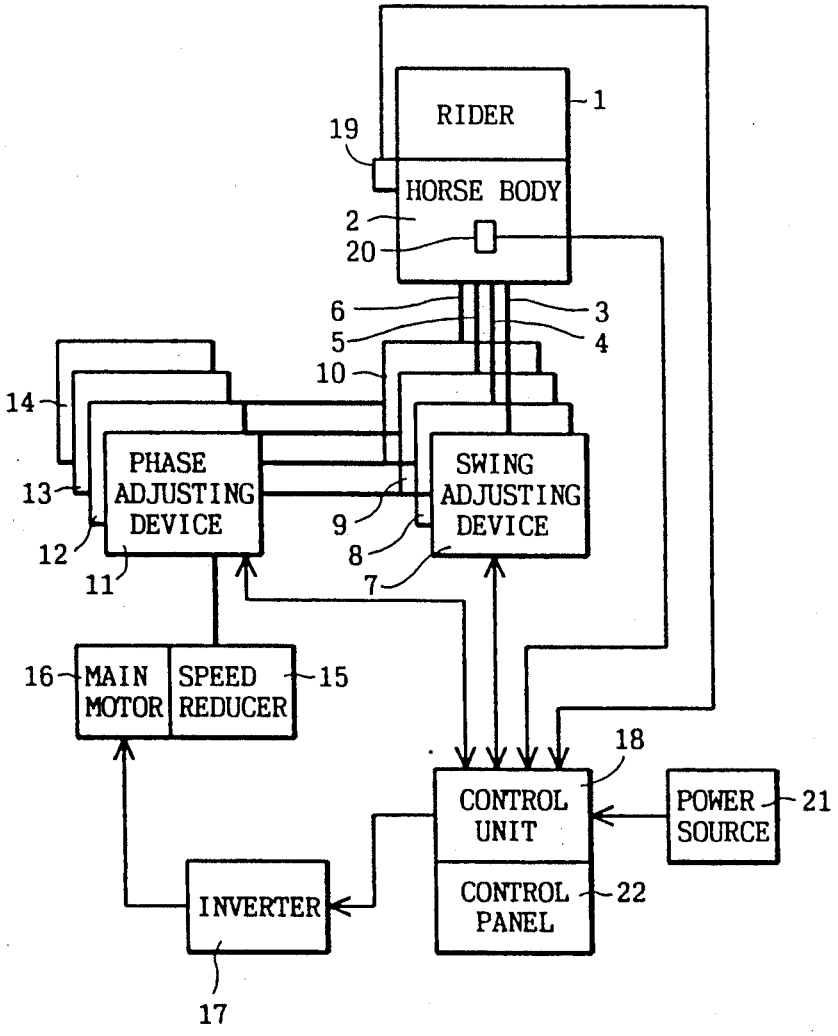
FIG. 1 is a block diagram illustrating the overall construction of a riding simulator of the present invention.

Referring first to FIG. 1, there is shown a control block diagram of the overall construction of a riding simulator according to a preferred embodiment of the present invention. As shown therein, an artificial horse body 2 on which a rider 1 is riding is supported by four legs consisting of a left foreleg 3, a left hind leg 4, a right foreleg 5 and a right hind leg 6. These legs 3, 4, 5 and 6 are attached at the lower ends thereof to swing adjusting devices 7, 8, 9 and 10, respectively, which serve to vary the length of swing of the horse body 2 as it is moved in vertical and longitudinal directions. The swing adjusting devices 7, 8, 9 and 10 are mechanically connected with phase adjusting devices 11, 12, 13 and 14, respectively.

The phase adjusting devices 11, 12, 13 and 14 are provided to produce phase difference between the vertical motion and the longitudinal motion of the horse body 2 and are connected to an output shaft of a speed reducer 15 provided in a main motor 16 so as to be driven by the main motor 16.

The rotational speed of the main motor 16 is variable under the control of an inverter 17 which generates driving power having variable frequencies. The inverter 17 is connected to a control unit 18 which constitutes the main part of the system. The control unit 18 produces to the inverter 17 a speed command as to rotation of the main motor 16. The control unit 18 is also connected to eccentricity setting motors 92 (which will be described later) provided respectively in the swing adjusting devices 7, 8, 9 and 10 and phase adjusting motors 127 (which will be described later) provided respectively in the phase adjusting devices 11, 12, 13 and 14. Further, the control unit 18 is electrically connected to a plurality of rein control detectors 19 for detecting control of a rein 33 (which will be described later) as the latter is drawn, and a plurality of leg motion detectors 20 attached to the abdomen of the horse body 2 and adapted to be actuated through the legs of the rider 1 on the horse body 2. The rein control detectors 19 and the leg motion detectors 20 are provided to detect, so called, aids given by the rider 1.

The control unit 18 is supplied with power from a power source 21, and is electrically connected to a control panel 22 for setting the operating mode for the horse body 2.

Figure 2:
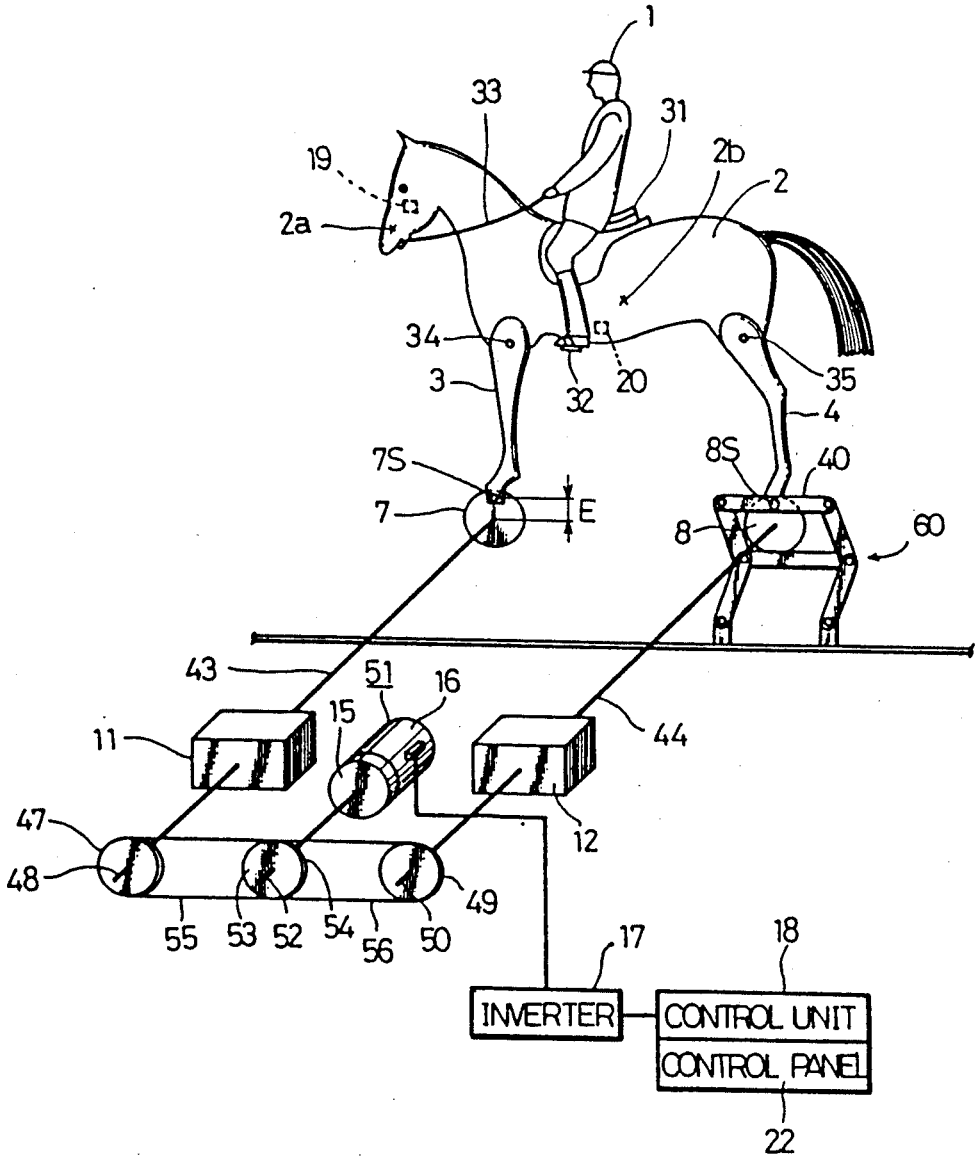
FIG. 2 is a schematic perspective view illustrating the drive control mechanism of the riding simulator.

FIG. 2 is a schematic perspective view illustrating the mechanical construction of the riding simulator shown in FIG. 1, in which are schematically illustrated the horse body 2, the swing adjusting devices 7 and 8, the phase adjusting devices 11 and 12, the speed reducer 15, the main motor 16 and other components. It is to be noted that FIG. 2 illustrates the construction associated with the left legs 3 and 4 of the horse body 2, and, of course, the swing adjusting devices 9 and 10 and the phase adjusting devices 13 and 14 similar to those described above are provided in association with the right legs 5 and 6 of the horse body 2.

As shown in FIG. 2, the horse body 2 is provided with a saddle 31 and stirrups 32 on which the feet of the rider 1 seating on the saddle 31 rest. A rein 33 is tied to the head 2*a* of the horse body 2, so that, when the rein 33 is drawn, the rein control detectors 19 detect the control of the rein 33 to output a rein control detection signal. The leg motion detectors 20 are attached to the abdomen 2*b* of the horse body 2, so that, when the rider 1 gives a sign through his legs, the leg motion detectors 20 output a leg motion detection signal.

The left foreleg 3 and the left hind leg 4 (hereinafter referred to simply as foreleg 3 and hind leg 4) of the horse body 2 are connected to the barrel of the horse body 2 for pivotal movement about a foreleg pivot 34 and a hind leg pivot 35, respectively. The foreleg 3 is pivotally supported at the lower end thereof on an eccentric shaft 7S attached to the swing adjusting device 7 which will be described later in greater detail. The hind leg 4 is fixedly connected to a support base 40 mounted on the swing adjusting device 8 which will be also described later. The support base 40 is horizontally swung by a linkage 60 which will be described later. Thus, the hind leg 4 is movable at a fixed angle to a horizontal plane. The eccentric distance E shown in FIG. 2 can be adjusted through control of an eccentricity setting motor (not shown). The greater the eccentric distance E is, the greater the swing becomes in the vertical and longitudinal motions.

A rotary shaft 43 for driving the swing adjusting device 7 is connected to the phase adjusting device 11, and a rotary shaft 44 for driving the swing adjusting device 8 is connected to the phase adjusting device 12. A pulley shaft 48 is inserted through a pulley 47, and a pulley shaft 50 is inserted through a pulley 49. The phase adjusting device 11 serves to adjust the phase between the rotary shaft 43 and the pulley shaft 48, and the phase adjusting device 12 serves to adjust the phase between the rotary shaft 44 and the pulley shaft 50, as will be described later in greater detail.

Rotational output of a driving unit 51 composed of the main motor 16 and the speed reducer 15 is transmitted through a driving shaft 52 of the driving unit 51 to pulleys 53 and 54 coaxially attached to the driving shaft 52. The pulley 53 rotates the pulley 47 through a timing belt 55, while the pulley 54 rotates the pulley 49 through a timing belt 56. With this arrangement, the main motor 16 receives driving power from the inverter 17 to be rotated at a rotational speed corresponding to the frequency of the driving power, and a rotational force reduced by the speed reducer 15 is transmitted through the pulley 53, the timing belt 55, the pulley 47 and the pulley shaft 48 to the phase adjusting device 11. At the same time, the rotational force is transmitted through the pulley 54, the timing belt 56, the pulley 49 and the pulley shaft 50 to the phase adjusting device 12. The phase adjusting devices 11 and 12 rotate the swing adjusting devices 7 and 8 at respective phase angles set by the phase adjusting motors. As the result, the foreleg 3 and the hind leg 4 (and also right foreleg 5 and right hind leg 6) are driven in the phases set in the phase adjusting devices 11 and 12 with the eccentric distance E set in the swing adjusting devices 7 and 8 to move the horse body 2 vertically and longitudinally.

Figure 3:
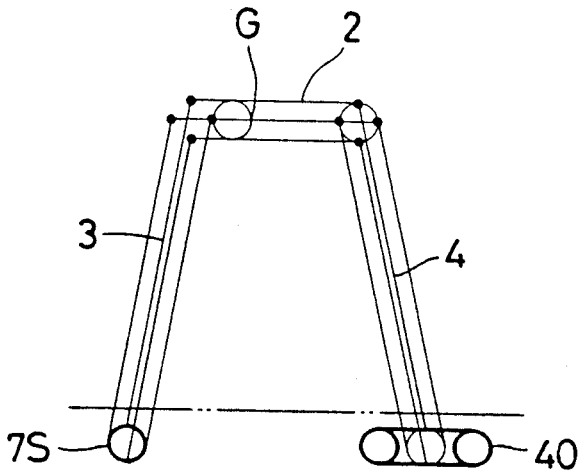
FIGS. 3, 4 and 5 are schematic views illustrating the path of an arbitrary point of the artificial horse body.
Figure 4:
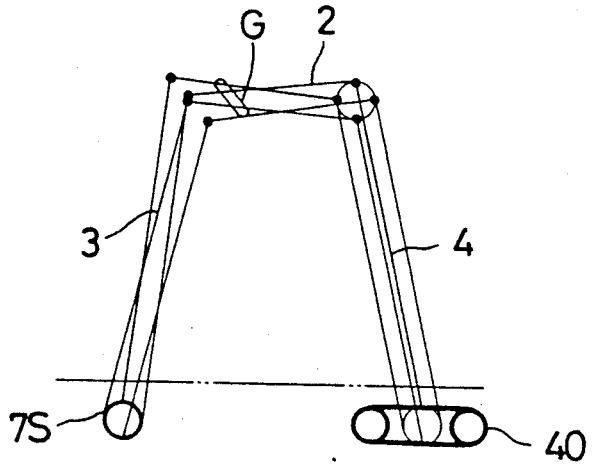
Figure 5:
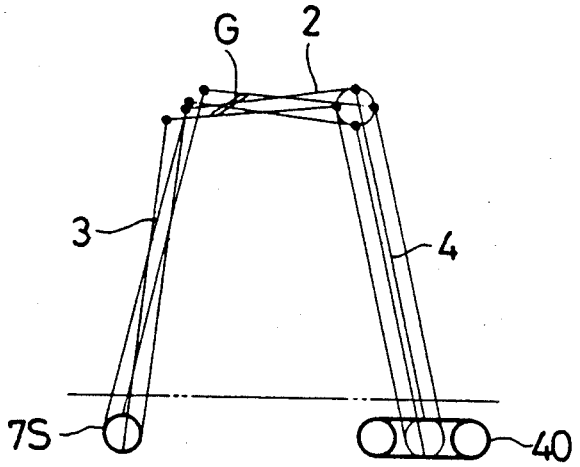

FIGS. 3, 4 and 5 illustrate the change in the path of a point G adjacent to the center of gravity of the horse body 2, that is, the phase difference between the vertical motion and the longitudinal motion of the horse body 2 and the swing thereof, when the phase difference between the foreleg 3 and the hind leg 4 is changed.

FIG. 3 illustrates the path of the point G when there is no phase difference between the foreleg 3 and the hind leg 4. In this condition, the point G moves in a circular path substantially equal to the circular paths of the eccentric shaft 7S and the support base 40. In other word, there is a phase lag of 90 degrees in the phase of the longitudinal motion of the horse body 2 in relation to the phase of the vertical motion thereof, and the swing in the vertical motion is equal to that in the longitudinal motion.

FIG. 4 illustrates the path of the point G when there is a phase lag of 90 degrees in the foreleg 3 in relation to the hind leg 4. In this condition, the point G moves in a depressed elliptical path declining to the right. In other words, there is substantially no phase difference between the vertical motion and the longitudinal motion, with the swing of the vertical motion substantially equal to that of the longitudinal motion. In this case, the point G moves in a manner corresponding to walk of a real horse.

FIG. 5 illustrates the path of the point G when the phase of the foreleg 3 is advanced by 90 degrees in relation to the phase of the hind leg 4. In this condition, the point G moves in a depressed elliptical path declining to the left. In other words, there is substantially no phase difference between the vertical motion and the longitudinal motion, with the length of the longitudinal swing motion being slightly larger than that of the vertical swing motion.

Thus, proper selection of the phase difference between the foreleg and the hind leg enables the point G of the horse body 2 to realize the movement (as to phase difference between the vertical motion and the longitudinal motion and respective swings thereof) corresponding to one of various gaits of a real horse.

To compare the motions of the riding simulator of the invention with those of a real horse, various motions of a standard real horse at different gaits were measured. The data are given in the Table below. It will be noted that the data show various motions of a point adjacent to the center of gravity of the real horse obtained in the form of a basic sine wave. Strictly speaking about the data, movement of a real horse is a combination of the above basic sine wave and higher harmonic wave component, but it has been found from measured data that the rate of the higher harmonic wave component is relatively small enough to be neglected and the data for practical simulation of the movement of a real horse can be satisfactorily derived only from the basic sine wave. Therefore, the riding simulating system of the embodiment is designed in accordance with the basic data shown in the Table.

TABLE

| Gait | Number of Swing per Second | Length of Swing Vertical (mm) | Length of Swing Longitudinal (mm) | Phase Difference between Vertical and Longitudinal Motions |
|---|---|---|---|---|
| Walk | 2 | 30 | 30 | $= 0$ |
| Trot | 3 | 30 | 30 | $\neq 0$ |
| Canter | 1.7 | 100 | 120 | $\neq 0$ |

As shown in the Table, in case of walk, the number of swing is 2, the length of swing is 30 mm in both vertical and longitudinal motions, and the phase difference between the vertical and longitudinal motions is 0.

At trot, the number of swing is 3, the length of swing is 30 mm in both vertical and longitudinal motions, as is the case at walk.

At canter, the number of swing is lowered to 1.7, and there is a slight difference in the length of swing in the directions, i.e. the length of vertical swing motion is 100 mm and the length of longitudinal swing motion is 120 mm.

It is believed that the phase difference at trot and the phase difference at canter are different from the phase difference at walk.

The riding simulator of the above construction operates as follows. Power is turned on through the control panel 22, and an operating mode setting switch not shown is set to select an operating mode which enables aides of the rider 1. With the operating mode set, the rider 1 rides on the saddle 31 places on the horse body 2 and puts his right and left feet on the stirrups 32.

It is assumed that right and left legs of the horse body 2 move in the same way, and description will be related to simple aids of starting, change of gaits and stopping.

When the rider 1 taps the abdomen **2*b* of the horse body 2 by his legs, the leg motion detectors 20 are actuated to output a detection signal therefrom. The detection signal is inputted into the control unit 18, which, in turn, outputs an initial speed command signal to the inverter 17** in accordance with the set operating mode.

The inverter 17, when receiving the command signal, outputs driving power having a frequency corresponding to the command signal to the main motor 16. As the result, the main motor 16 starts rotation, and the driving force is transmitted in the manner as described above, causing the horse body 2 to start moving.

At the above starting, the gait is initially set to walk in which the swing is set to 30 mm in the swing adjusting devices 7 and 8, the phase difference is set to −90 degrees and the main motor 16 drives the swing adjusting devices 11 and 12 at 2 times.

After the horse body 2 is moved with the gait of walk for a suitable period of time, the rider 1 may tap the abdomen 2*b* of the horse body 2 by his legs to cause the leg motion detectors 20 to output a detection signal to the control unit 18 in the same manner as starting. The control unit 18, when receiving the detection signal, drives the phase setting motors of the phase adjusting devices 11 and 12 and the eccentricity setting motors of the swing adjusting devices 7 and 8 to automatically set the phase difference of the phase adjusting devices 11 and 12 and the eccentric distance E of the swing adjusting devices 7 and 8 to the values corresponding to trot, respectively, with the swing adjusting devices 7 and 8 being rotated at 3 times. As the result, the horse body 2 is moved with the gait of trot.

When the rider 1 taps the abdomen 2*b* of the horse body 2 in the above trot condition, the control unit 18 automatically set the phase difference of the phase adjusting devices 11 and 12 and the eccentric distance E of the swing adjusting devices 7 and 8 to the values corresponding to canter, with the swing adjusting devices 7 and 8 being rotated at 1.7 times. Thus, the horse body 2 is moved with the gait of canter.

In order to stop the horse body 2, the rider 1 draws the rein 33 relatively strongly. Such drawing of the rein 33 causes the rein control detectors 19 to be actuated, and a detection signal is outputted from the rein control detectors 19 to the control unit 18, which stops output of the driving command signal to the inverter 17 to stop rotation of the main motor 16. At the same time as the main motor 16 is stopped, the control unit 18 returns the phase difference and the eccentric distance E to the initial values associated with walk.

Though the above operational description is based upon the assumption that the left and right forelegs 3 and 5 move in conformity with each other and the left and right hind legs 4 and 6 move in conformity with each other, the control panel 22 may be set to such an operating mode in which there is a phase difference between the right and left legs. In such a case, the horse body 2 rotatingly swings about an axis in the advancing direction, or carries out rolling, providing movement more similar to that of a real horse. Thus, separate movement of each of the four legs enables the horse body 2 to realize rolling.

Real horses have individual characteristics and are slightly different in movement from one another. Accordingly, the number and length of swing and the phase may be changed as desired so as to achieve individual horse-like movements.

As described above, the riding simulator of the present invention enables the rider 1 to give aids for selecting a desired gait, permitting enjoyment of riding quite similar to that on a real horse as well as acquirement of riding techniques to brush up riding on a real horse.

In the foregoing description of the riding simulator, the rider 1 is assumed to be a beginner, and the horse body 2 can be driven by simple aids given by the rider 1, but actual aids are more complex. Specifically, in addition to aids through the rein and legs, aids can be given through knees, feet and shift of the center of gravity of the rider. Therefore, various detectors may be mounted on suitable positions of the horse body 2 for detecting the above various aids, so that a more improved riding simulator may be provided which permits change of pace, change of direction or the like. Such detectors will be described later in greater detail.

The support structure for the horse body 2 will now be described with reference to FIGS. 6 to 8.

Figure 6:
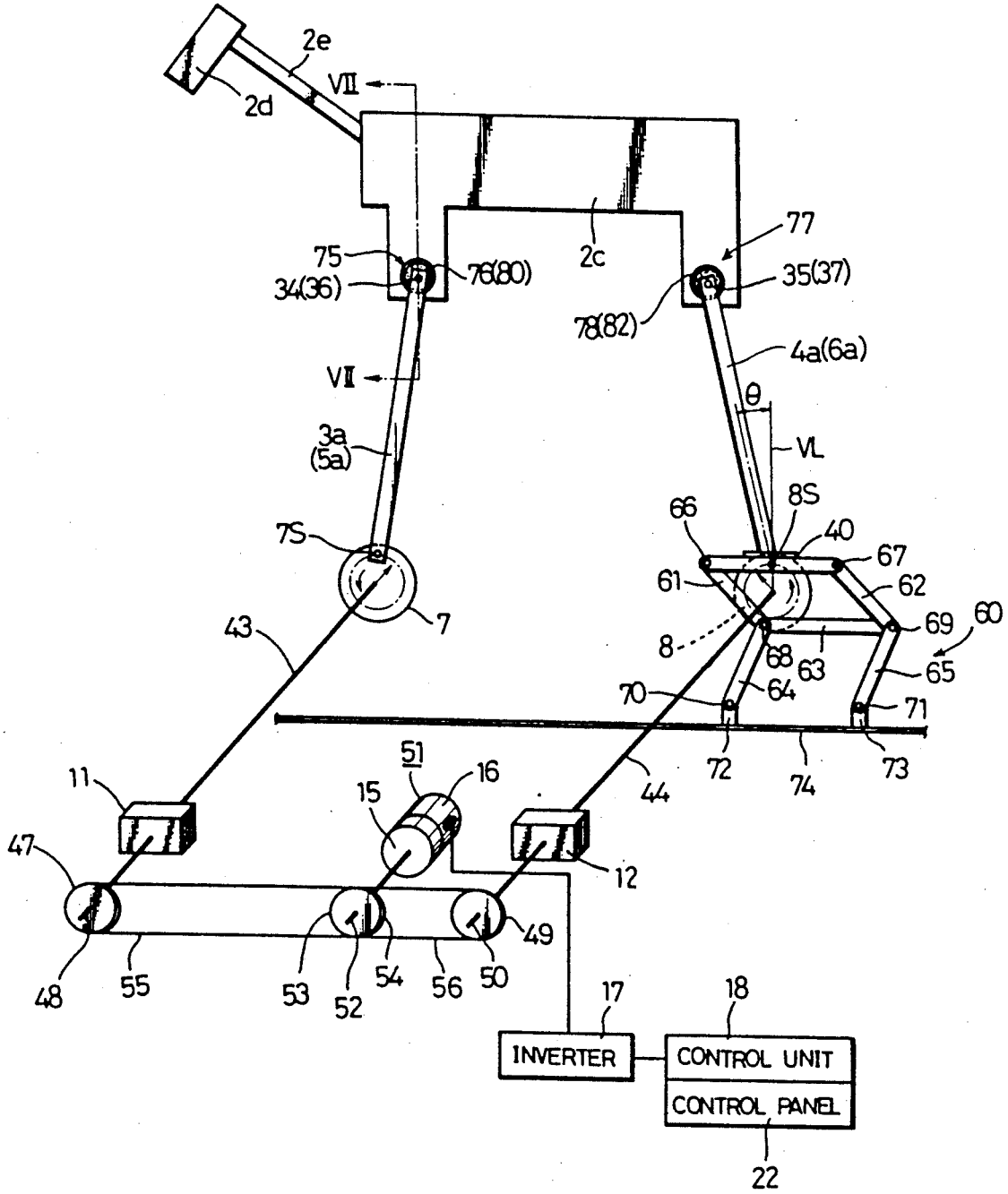
FIG. 6 is a schematic view of the support structure for the artificial horse body.

The horse body 2 shown in FIG. 2 has a frame structure shown in FIG. 6 and covered by an artificial or a real horse leather. Specifically, the frame structure is comprised of a barrel 2*c*, a head 2*d*, a neck 2*e*, a left foreleg 3*a* and a left hind leg 4*a* as well as a right foreleg 5*a* and a right hind leg 6*a* which are not seen in FIG. 6. The left foreleg 3*a* is pivotally supported at the lower end thereof on the eccentric shaft 7S attached to the swing adjusting device 7. The left hind leg 4*a* is attached at the lower end thereof to the support base 40 constituting a part of the linkage 60. The support base 40 is pivotally supported on an eccentric shaft 8S of the swing adjusting device 8 which will be described later. The linkage 60 is composed of the support base 40, links 61, 62, 63, 64 and 65 and pins 66, 67, 68, 69, 70 and 71 for connecting the links, and is mounted on a base 74 through fixing members 72 and 73.

Figure 7:
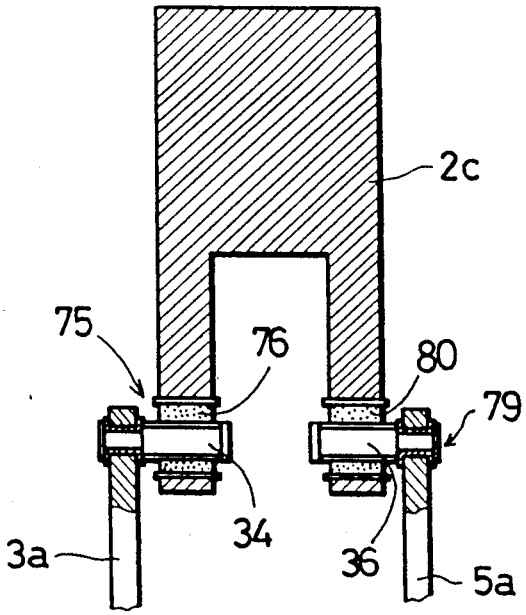
FIG. 7 is a sectional view taken in the direction of the arrows along the line VII—VII of FIG. 6.
Figure 8:
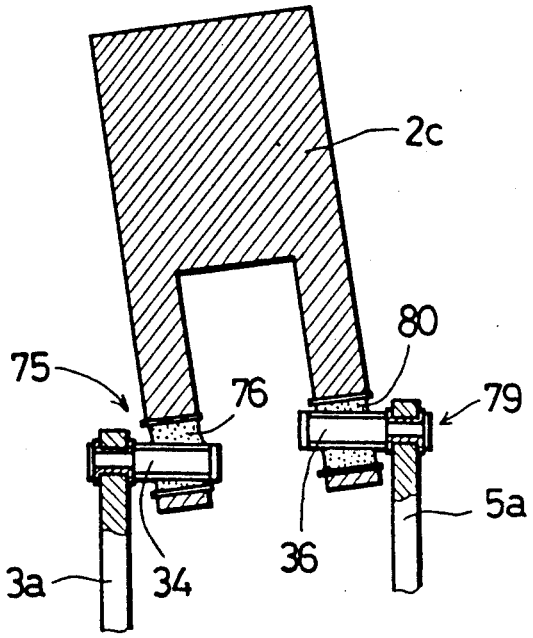
FIG. 8 is a sectional view similar to FIG. 7 and illustrating the operation of the support structure.

A cylindrical distortion-absorbing member 76 made of, for example, rubber and having a predetermined spring constant is fitted in a connection 75 of the barrel 2*c* to which the upper end of the left foreleg 3*a* is to be connected, as shown in FIG. 7. The pivot 34 is received in the central portion of the distortion-absorbing member 76, and the upper end of the left foreleg 3*a* is pivotally connected to the pivot 34.

A similar cylindrical distortion-absorbing member 78 having a predetermined spring constant is fitted in a connection 77 of the barrel 2*c* to which the upper end of the left hind leg 4*a* is to be connected. The pivot 35 is received in the central portion of the distortion-absorbing member 78, and the upper end of the left hind leg 4*a* is connected to the pivot 35.

As shown in FIG. 7, a distortion-absorbing member 80 is fitted in a connection 79 of the barrel 2*c* to which the upper end of the right foreleg 5*a* is to be connected, and a pivot 36 is received in the distortion-absorbing member 80. Similarly, as schematically shown in FIG. 7, a distortion-absorbing member 82 and a pivot 37 are fitted in a connection of the barrel 2*c* to which the upper end of the right hind leg 6*a* is to be connected.

Figure 9:
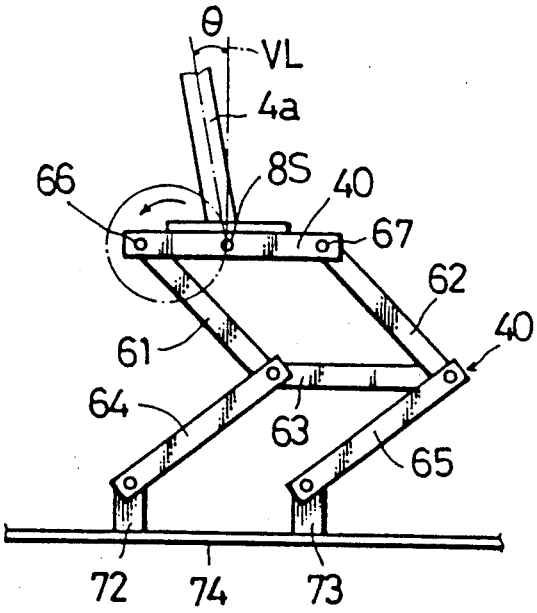
FIGS. 9, 10 and 11 are schematic views illustrating the operation of the linkage.
Figure 10:
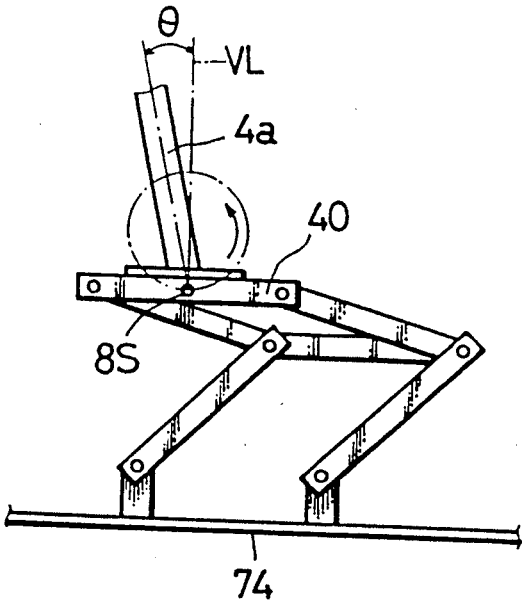
Figure 11:
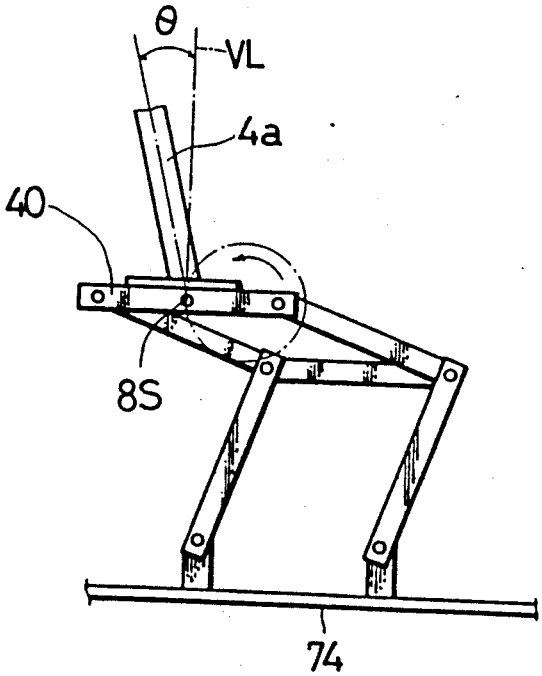

In the horse body supporting structure thus constructed, the support base 40 is swung by the linkage 60 in a horizontal direction at all times, as shown in FIGS. 9, 10 and 11, and therefore, the inclination $\theta$ of the left hind leg 4*a* to a vertical line VL is constant. During such movement, even if the radius of rotation of the eccentric shaft 8S of the swing adjusting device 8, that is, the length of swing of the left hind leg 4*a* is changed, the inclination $\theta$ of the left hind leg 4*a* to the vertical line VL is held constant.

When the left foreleg 3*a*, the left hind leg 4*a*, the right foreleg 5*a* and right hind leg 6*a* are driven in separate phases, the support base 40 is also rotated horizontally, but the pivots 34, 35, 36 and 37 connected to the respective legs are at separate heights. In other words, the horse body 2 carries out rolling (swing about the X axis)

and pitching (swing about the y axis). In the pitching, pivotal movement of the pivots assures smooth swing of the barrel 2*c* of the horse body 2. Specifically, in the pitching, the barrel 2*c* is inclined as shown in FIG. 8, causing mechanical distortion, but as the mechanical distortion is absorbed by the distortion-absorbing members 76, 78, 80 and 82, the horse body 2 can swing smoothly. The spring constant of the distortion-absorbing members 76, 78, 80 and 82 is preferably small, but they must be so selected that the natural frequency of the horse body supporting structure is substantially more than two times the number of swing for driving the horse body 2.

The horse body supporting structure of the present invention permits, in addition to the above rolling and pitching, yawing of the horse body 2, or swing about the Z axis, providing movement more similar to that of a real horse.

Figure 12:
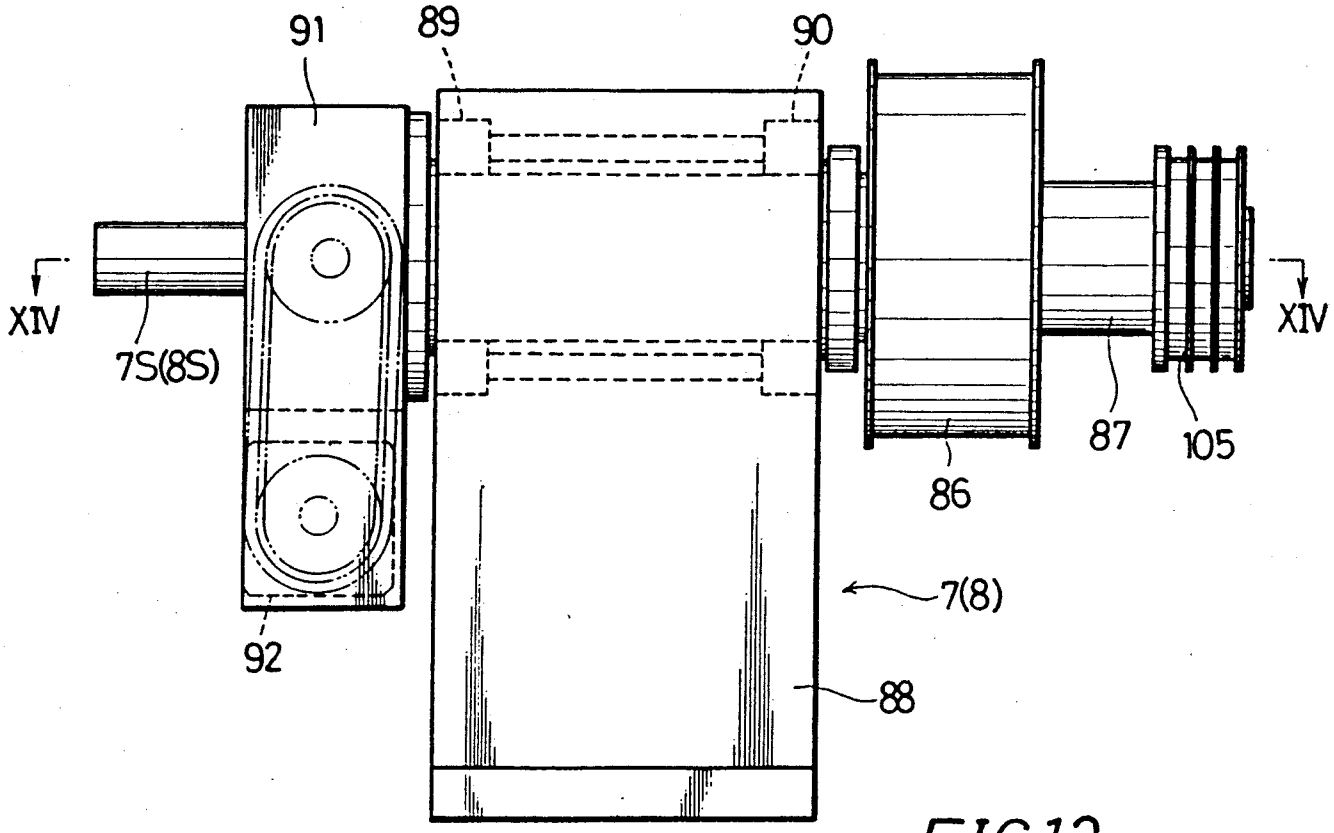
FIG. 12 is a side view of the swing adjusting device.
Figure 13:
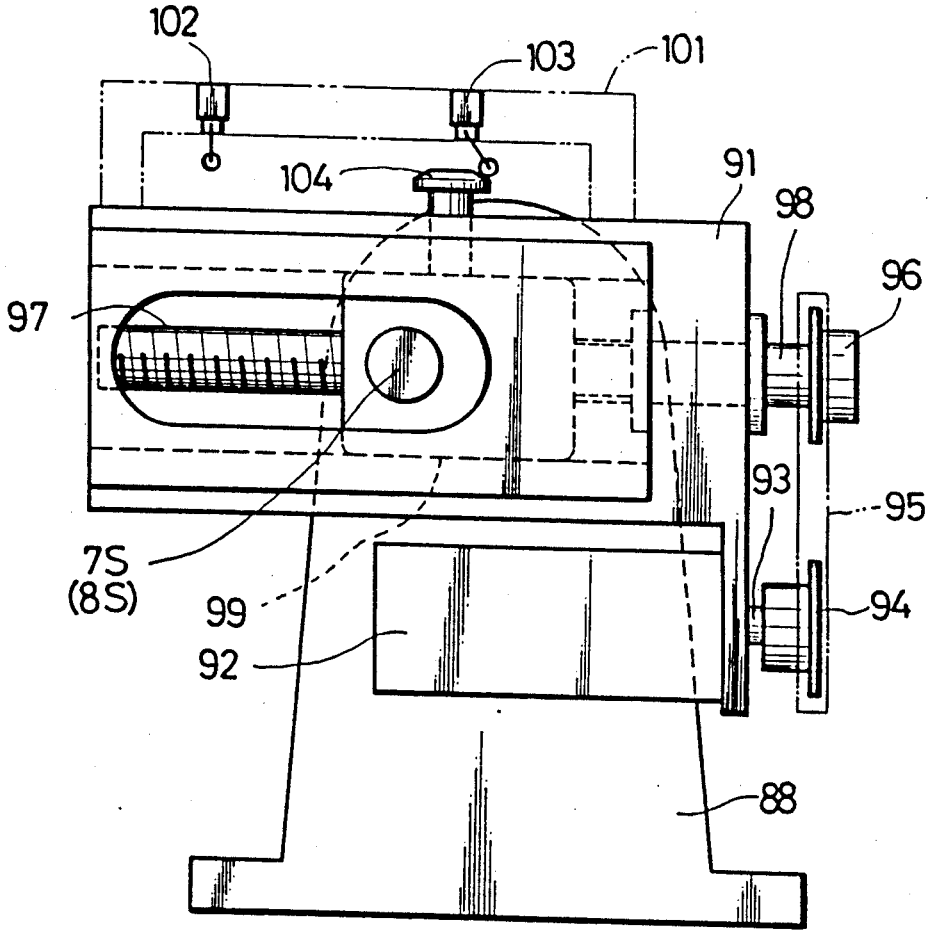
FIG. 13 is a front view of the swing adjusting device.
Figure 14:
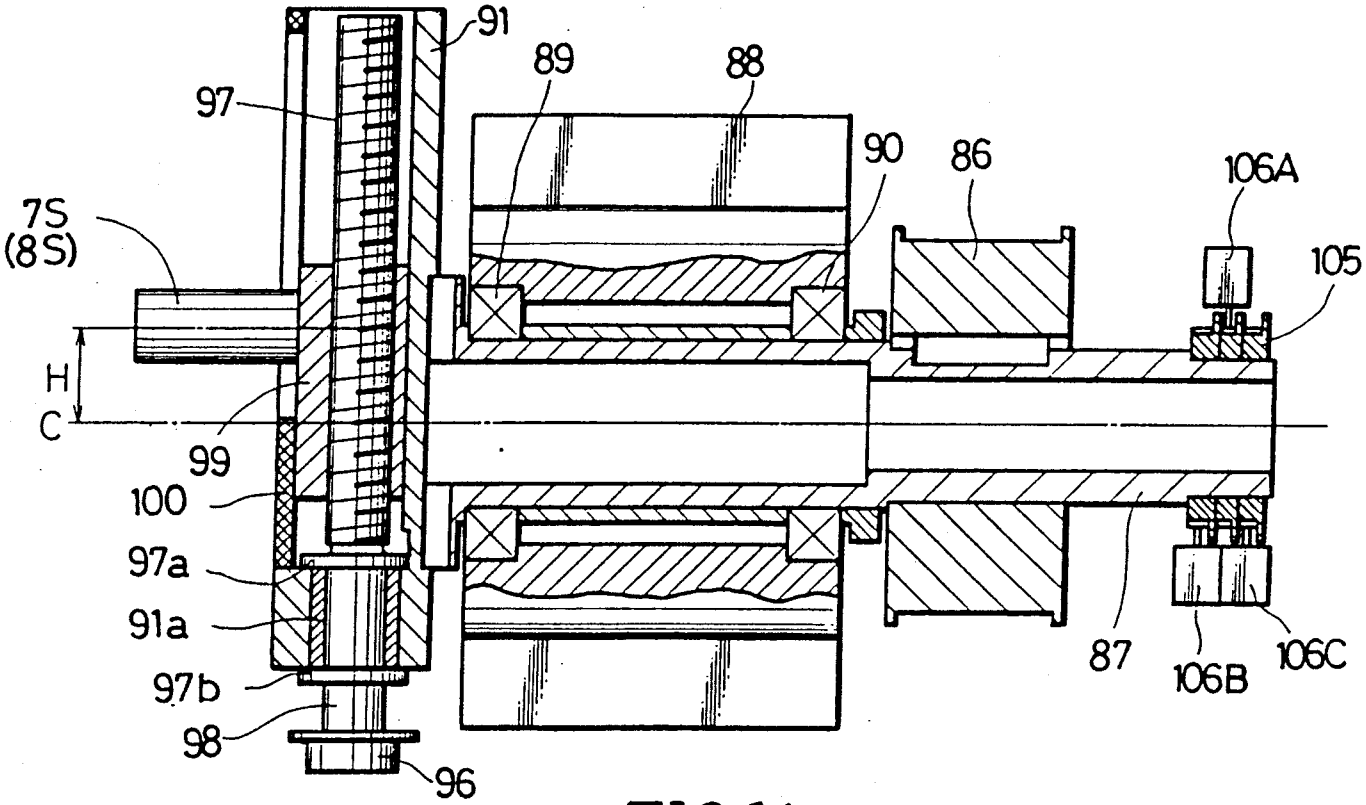
FIG. 14 is a sectional view taken along line XIV—XIV of FIG. 12.

Referring next to FIGS. 12 to 14, the swing adjusting devices 7 and 8 will be described. It will be noted that the swing adjusting devices 7 and 8 are of the same construction.

In FIGS. 12 and 13, rotational force is transmitted through a pulley (not shown) mounted on the rotary shaft 43 and a timing belt (not shown) trained around the pulley to a main pulley 86 mounted on a main driving shaft 87. The main driving shaft 87 extends through a bearing case 88 fixed on the base 74 and is journaled in bearings 89 and 90 provided in the bearing case 88. The main driving shaft 87 is provided at one end thereof with a guide case 91 attached rotatably along with the main driving shaft 87. A motor 92 rotatable in the forward and reverse directions is attached to the guide case 91 and has an output shaft 93 on which a driving sprocket 94 is mounted. A chain 95 is trained around the driving sprocket 94. A driven sprocket 96 is fitted on an input shaft 98 of a screw 97 provided in the guide case 91. When driving power is supplied from the control unit 18 to the motor 92, the motor 92 is driven to rotate the driving sprocket 94, which, in turn, rotates the driven sprocket 96 through the chain 95.

As shown in FIG. 14, a slide block 99, surrounded by a guide plate 100, is slidably received in a U-shaped groove in the guide case 91, and the screw 97 is threadedly engaged in and meshed with the slide block 99, so that when the driven sprocket 96 is rotated by the driving force from the motor 92, the slide block 99 is linearly moved in the axial direction of the screw 97. The screw 97 is journaled in a screw bearing 91*a* provided in the guide case 91 between flanges 97*a* and 97*b* formed on the input shaft 98.

An eccentric shaft 7S(8S) for supporting the foreleg 4 (the hind leg 5) is secured to the slide block 99, so that, as the slide block 99 is moved in the axial direction of the screw 97, the eccentric shaft 7S(8S) can be moved to a desired position eccentric from the center of rotation C of the guide case 91 by the distance H.

As shown in FIG. 13, a bracket 101 is secured to the guide case 91 so as to positionally adjustably mount two limit switches 102 and 103 for electrically limiting the range of movement of the slide block 99. The slide block 99 is provided with a striker 104 for actuating the limit switches 102 and 103. Thus constructed, as the slide block 99 is moved away from the center of rotation of the guide case 91 in the axial direction of the screw 97, the striker 104 is brought into abutment with the limit switch 102, which generates an actuation signal. In this condition, the largest swing is obtainable.

When the eccentric shaft 7S(8S) is moved to the position closest to the center of rotation of the guide case 91, the striker 104 actuates the limit switch 103, which generates an actuation signal. In this condition, the smallest swing is obtainable.

As shown in FIG. 12, the main driving shaft 87 is provided at the other end thereof with a three-electrode slip ring 105 having an electrode for supplying driving current from the control unit 18 to the motor 92, and two electrodes for transmitting actuation signals from the limit switches 102 and 103 to the control unit 18. As shown in FIG. 14, brushes 106A, 106B and 106C to be electrically connected with the respective electrodes of the slip ring 105 are fixed to a slip ring case (not shown), and are electrically connected with the control unit 18. While not shown, cables are provided for connection between the electrodes of the slip ring 105, the motor 92 and the limit switches 102 and 103, and are passed through a hollow portion of the main driving shaft 87.

The swing adjusting device 7(8) of the above construction operates as follows. When a stepping mode of the horse body 2 is selected through the setting switch of the control panel 22, the control unit 18 selects the number and length of swing in the vertical and longitudinal directions of the horse body 2 in accordance with the selected mode in the electrical circuit.

After the above initial setting is completed, depression of a starting switch (not shown) causes the main motor 16 to be driven and consequently the rotary shafts 43(44) to be rotated, and the rotational force is transmitted to the main driving shaft 87 of the swing adjusting device 7(8).

When the guide case 91 is rotated along with the main driving shaft 87 and when driving current is supplied from the control unit 18 through the slip ring 105 to the motor 92, the motor 92 is rotated in accordance with the driving current and causes rotation of the screw 97 through the driving sprocket 94, the chain 95 and the driven sprocket 96. As the screw 97 is rotated, the slide block 99 threadedly engaged with the screw 97 is slidingly moved in the axial direction of the screw 97, so that the eccentric shaft 7S(8S) secured to the slide block 99 is eccentrically shifted by the distance corresponding to the driving amount of the motor 92.

During this sliding movement of the slide block 99, the striker 104 secured to the slide block 99 is brought into abutment with the limit switches 102 and 103, which generate actuation signals which, in turn, are inputted into the control unit 18 to cause the motor 92 to be stopped or to be driven in the reverse direction.

As the result, the foreleg 3 (hind leg 4) is swung in proportion to the eccentric distance of the eccentric shaft 78(8S), and consequently, the horse body 2 is moved in the vertical and longitudinal directions at the length of swing corresponding to the above eccentric distance. The length of swing is determined by the set positions of the limit switches 102 and 103.

The horse body 2 o( the above construction swings in accordance with the rotational speed of the main driving shaft 87 and moves in the vertical and longitudinal directions in accordance with the eccentric distance of the eccentric shaft 7S(8S). Thus, the number and length of swing of the stepping action of the horse body 2 can be set separately. During the movement of the horse body 2, the motor 92 can be driven under the control of the control unit 18 to adjust the length of swing of the horse body 2 as desired as well as the number of swing thereof as desired.

Though two limit switches 102 and 103 are used in the above embodiment, the number of the limit switches may be increased and also the number of the electrodes of the slip ring 105 may be increased so as to obtain finer adjustment of the swing.

The chain 95 trained around the driving sprocket 94 and the driven sprocket 96 may be replaced by a belt such as a flat belt, a V-belt and a toothed belt or a gear such as a spur gear, a bevel gear and a worm gear.

Figure 15:
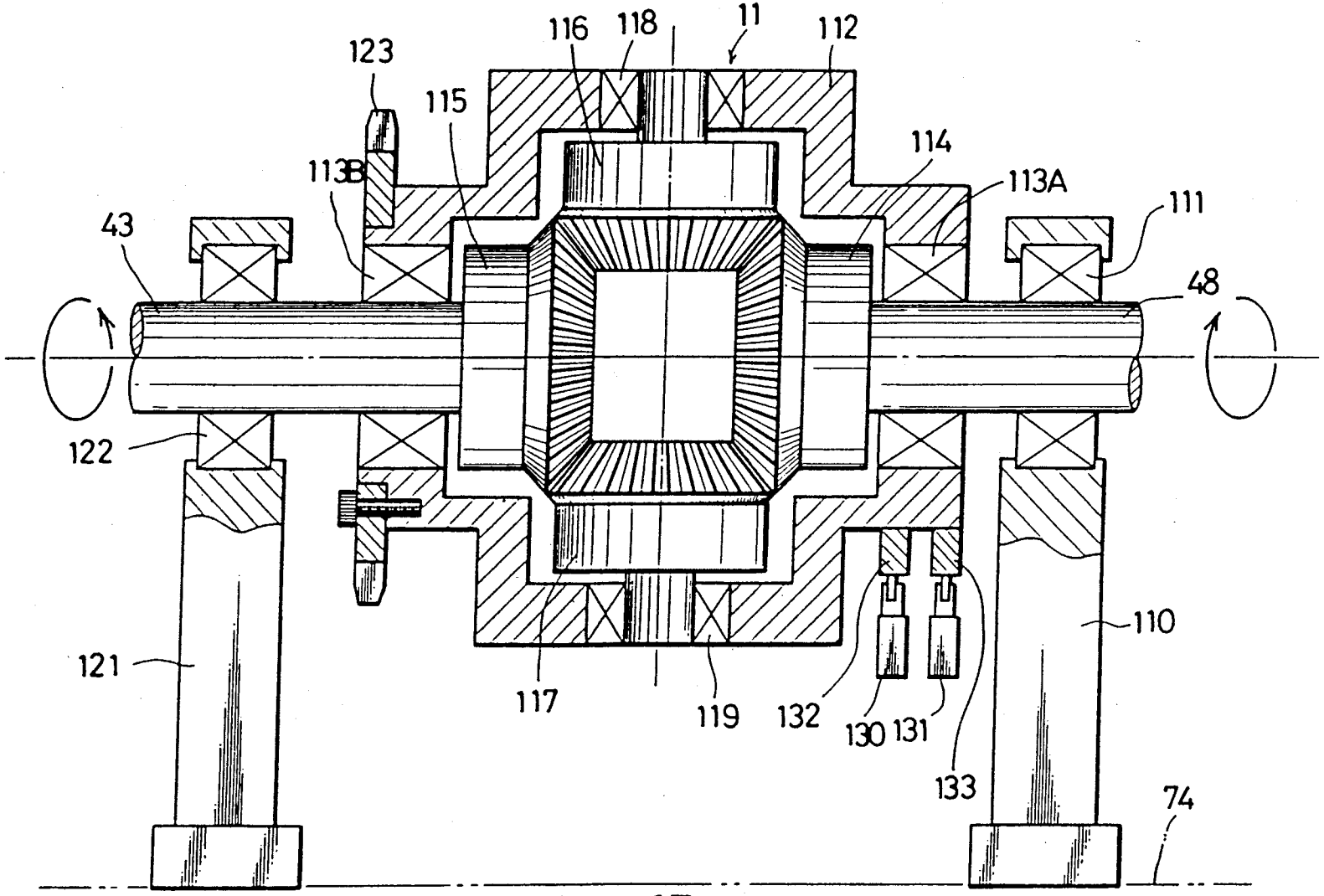
FIG. 15 is a sectional side view of the phase adjusting device.
Figure 16:
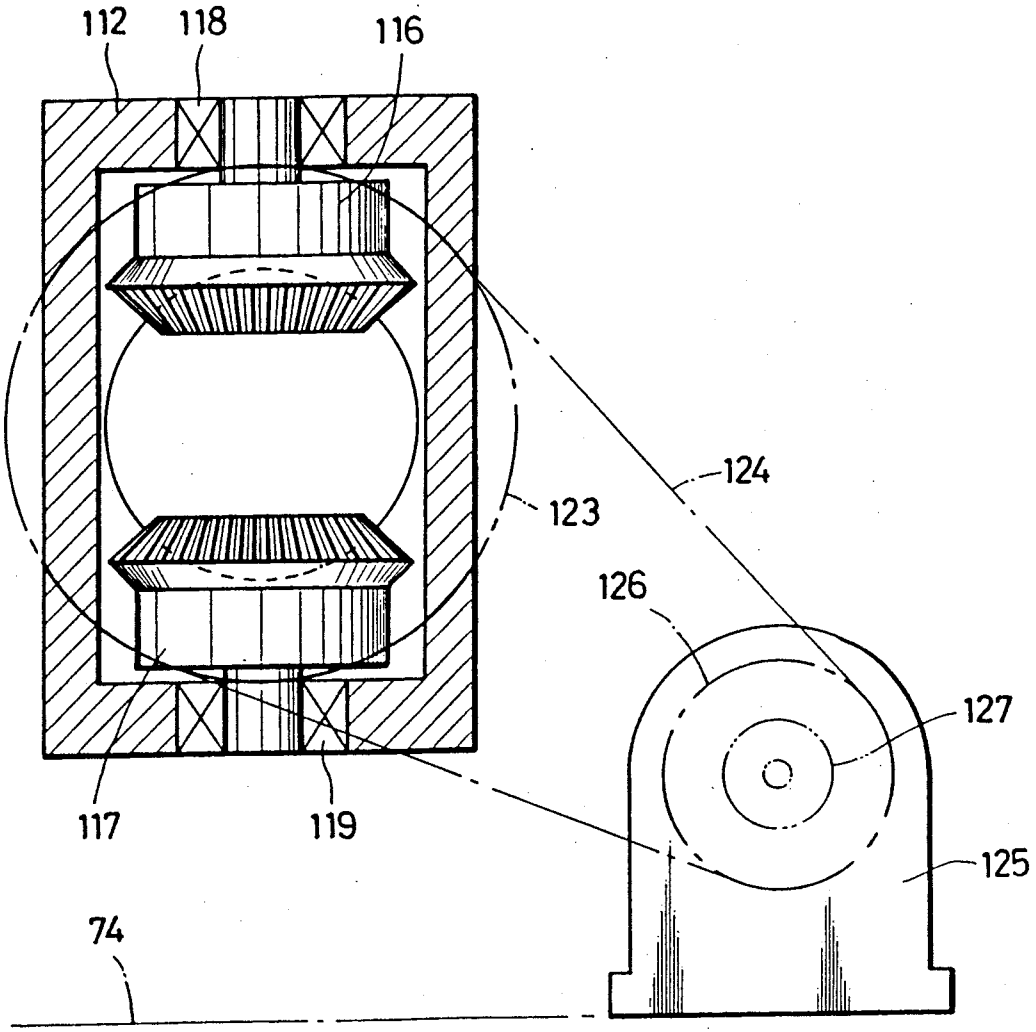
FIG. 16 is a sectional front view of the phase adjusting device.

Referring next to FIGS. 15 and 16, the phase adjusting devices 11 and 12 will be described. It will be noted that the phase adjusting devices 11 and 12 are of the same construction. For purpose of illustration, reference will hereinafter be made to the phase adjusting device 11.

As shown in FIG. 15, the pulley shaft (or driving shaft) 48 inserted through the pulley 47 is journaled in a bearing 111 provided in a bearing holder 110 fixed on a base 74. The pulley shaft 48 is also journaled in a bearing 113A provided in a gear case 112. The gear case 112 encases a driving gear 114 connected to the pulley shaft 48, a driven gear 115 connected with the rotary shaft (or driven shaft) 43 and intermediate gears 116 and 117 meshed with the driving gear 114 and the driven gear 115. The intermediate gears 116 and 117 are respectively journaled in bearings 118 and 119 provided in the gear case 112, so that the intermediate gears 116 and 117 are rotatable on their common axis and revolvable around the common axis of the pully shaft 48 and the rotary shaft 43. Thus, the gear case 112 serves as a support for the intermediate gears 116 and 117, and the driving gear 114, the driven gear 115 and the intermediate gears 116 and 117 cooperate to constitute a differential gear mechanism.

The rotary shaft 43 is journaled in a bearing 113B provided in the gear case 112 and also journaled in a bearing 122 provided in a bearing holder 121 fixed on the base 74 in the vicinity of the gear case 112.

A sprocket 123 is fitted on an end face of the gear case 112 adjacent to the bearing holder 121, and as shown in FIG. 16, a chain 124 is trained around the sprocket 123. The chain 124 is also trained around a sprocket 126 of a gear case driving unit (intermediate gear support driving unit) 125 mounted on the base 74. The gear case driving unit 125 incorporates a reversible motor 127 with a brake, and a speed reducer (not shown), and the motor 127 is electrically connected to the control unit 18. With this arrangement, when driving current is supplied from the control unit 18 to the motor 127, the sprocket 126 is turned through the speed reducer, and the driving force transmitted through the chain 124 turns the sprocket 123 and consequently the gear case 112. As the gear case 112 is turned, the intermediate gears 116 and 117 are rotated on their common axis and revolved around the common axis of the pulley shaft 48 and the rotary shaft 43, producing difference in turning angle or phase difference between the pulley shaft 48 and the rotary shaft 43.

In order to set the turning angle of the gear case 112, two limit switches 130 and 131 are attached to a limit switch supporting bracket (not shown), and two switch dogs 132 and 133 are positionally adjustably provided on the outer periphery of the other end of the gear case 112 to actuate the limit switches 130 and 131, as shown in FIG. 15. The limit switches 130 and 131 are electrically connected with the control unit 18, and as the gear case 112 is turned, they are brought into abutment with the switch dogs 132 and 133 to generate a signal to the control unit 18, which, in turn, stops supply of the driving current to the motor of the gear case driving unit 125. In other words, the turning angle of the gear case 112 is determined in accordance with the set position of the switch dogs 132 and 133, and at this time, the brake is operated to restrict rotation of the motor, so that the turning position of the gear case 112 is determined.

The phase adjusting device 11 of the above construction operates as follows. When the rider 1 rides on the horse body 2 and gives an aid, for example, by his legs, the control unit 18 generates a phase adjusting signal to supply the driving current from the control unit 18 to the motor of the gear case driving unit 125. As the result, the motor is rotated, causing the sprocket 126 to turn through the speed reducer, and the driving force transmitted through the chain 124 turns the sprocket 123, for example, in the clockwise direction to turn the gear case 112 in the clockwise direction. As the gear case 112 is turned in the above direction, the switch dog 133 is brought into abutment with the limit switch 131, which generates a signal to the control unit 18, which, in turn, stops supply of the driving current to the motor of the driving unit 18. As the result, the motor is locked by the brake, and turning of the gear case 112 is stopped at the position.

When the set position of the switch dog 132 in relation to the limit switch 130 is at the origin where the phase difference between the pulley shaft 48 and the rotary shaft 43 is zero and the set position of the switch dog 133 in relation to the limit switch 131 is 30 degrees apart from the origin, with the gear ratio of the driving gear 114 to the driven gear 115 in the differential gear mechanism composed of the driving and driven gears 114 and 115 and the intermediate gears 116 and 117 being 1:1, the gear case 112 is stopped at a position 30 degrees rotated from the origin, and the difference in turning angle or the phase difference of the rotary shaft 43 from the pulley shaft 48 is 60 degrees, the rotary shaft 43 being rotated 60 degrees clockwise in advance of the pulley shaft 48. This results from the combination of the rotation of the intermediate gears 116 and 117 on their common axis and the revolution thereof around the common axis of the pulley shaft 48 and the rotary shaft 43. The gear case 112 may be turned when the pulley shaft 48 is being rotated or at a standstill.

As described above, the phase adjusting device 11 can set the phase difference of the rotary shaft 43 from the pulley shaft 48 as desired in accordance with the set position of the switch dog 133. Thus, the phase differences of the phase adjusting devices associated with the respective legs of the horse body 2 can be set in conformity with the stepping actions of a real horse to move the horse body 2 like a real horse.

Though, in the above embodiment, two limit switches 130 and 131 and two switch dogs 132 and 133 are provided for setting the turning angle of the gear case 112, the number of the limit switches and the switch dogs may be increased to obtain finer adjustment of the difference of the turning angle of the rotary shaft 43 in relation to the pulley shaft 48.

Furthermore, the chain 124 used to transmit the torque of the sprocket 126 to the sprocket 123 may be replaced by a belt such as a flat belt, a V-belt and a toothed belt or a gear such as a spur gear, a bevel gear and a worm gear. The power source of the gear case driving unit 125 may be pneumatic or hydraulic cylinder in place of the electric motor.

The system for training of riding will now be described with reference to FIG. 17.

Figure 17:
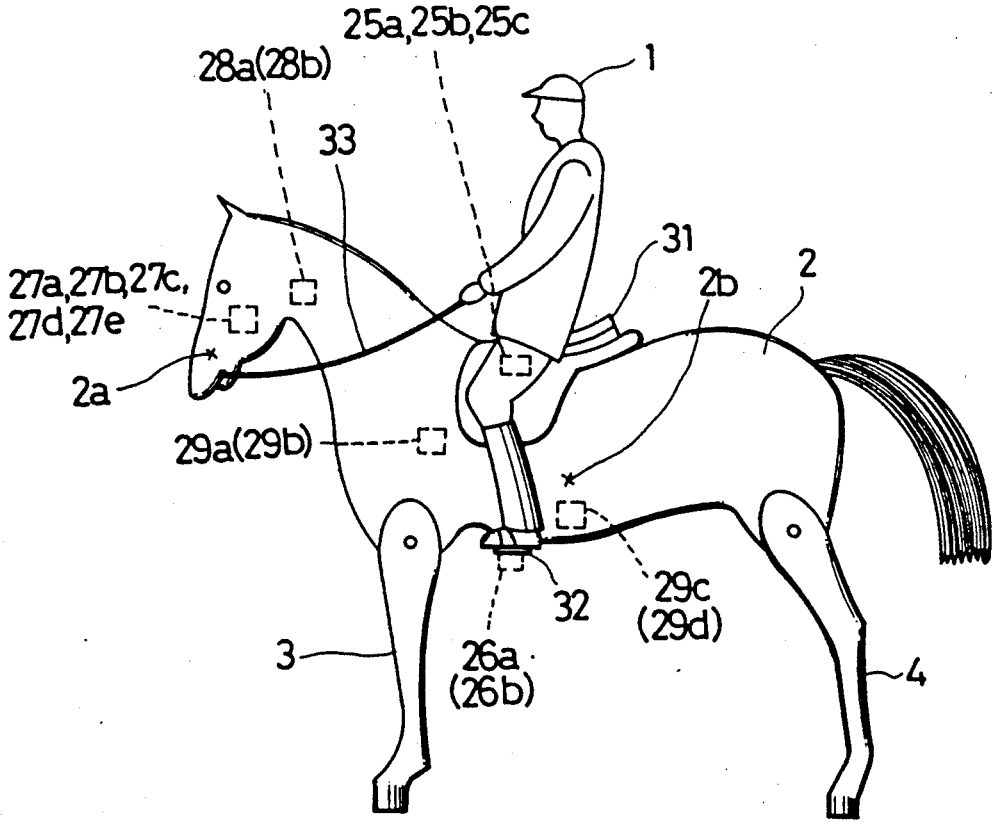
FIG. 17 is a schematic view illustrating the location of various sensors of the horse body.

As shown in FIG. 17, the horse body 2 is provided on the back thereof with a saddle 31 and on the right and left sides thereof with stirrups 32 on which the right and left feet of the rider 1 seating on the saddle 31 rest. In the back of the horse body 2 is provided saddle load sensors 25*a*, 25*b* and 25*c* adapted for detecting the load of the saddle 31, weight of the rider 1 and loading caused by the shift of the weight of the rider 1 and outputting detection signals in response to the detected load and loading. The saddle load sensors 25*a*, 25*b* and 25*c* are comprised of piezoelectric elements or strain gauges. Though three saddle load sensors 25*a*, 25*b* and 25*c* are provided in this embodiment, the number thereof may be increased to permit finer detection. The right and left stirrups 32 are provided with stirrup load sensors 26*a* and 26*b* in the form of piezoelectric elements for detecting loads applied by the legs of the rider 1.

The rein 33 is tied to the head 2*a* of the horse body 2, and the head 2*a* is provided with head sensors 27*a*, 27*b*, 27*c*, 27*d* and 27*e* in the form of limit switches. The head sensors 27*a*, 27*b*, 27*c*, 27*d* and 27*e* correspond to the rein control detectors 19 previously described and serve to detect the force applied to the rein 33 at a plurality of positions when the rein 33 is drawn and to output detection signals corresponding to the strength and direction of the detected force. The horse body 2 has a connection between the head 2*a* and the neck which is so designed as to be movable in response to the force applied when the rein 33 is drawn. Neck sensors 28*a* and 28*b* in the form of limit switches are provided on the right and left sides of the connection and are adapted to detect the force applied to the connection and output signals corresponding to the detected force.

The horse body 2 is further provided on the right and left sides of the abdomen 2*b* with abdomen sensors 29*a*, 29*b*, 29*c* and 29*d* in the form of limit switches. The abdomen sensors 29*a*, 29*b*, 29*c* and 29*d* correspond to the leg motion detectors 20 previously described and serve to detect aids given by the legs of the rider 1 at the heels and the insides of the knees, irrespective of the physique of the rider 1.

Figure 18:
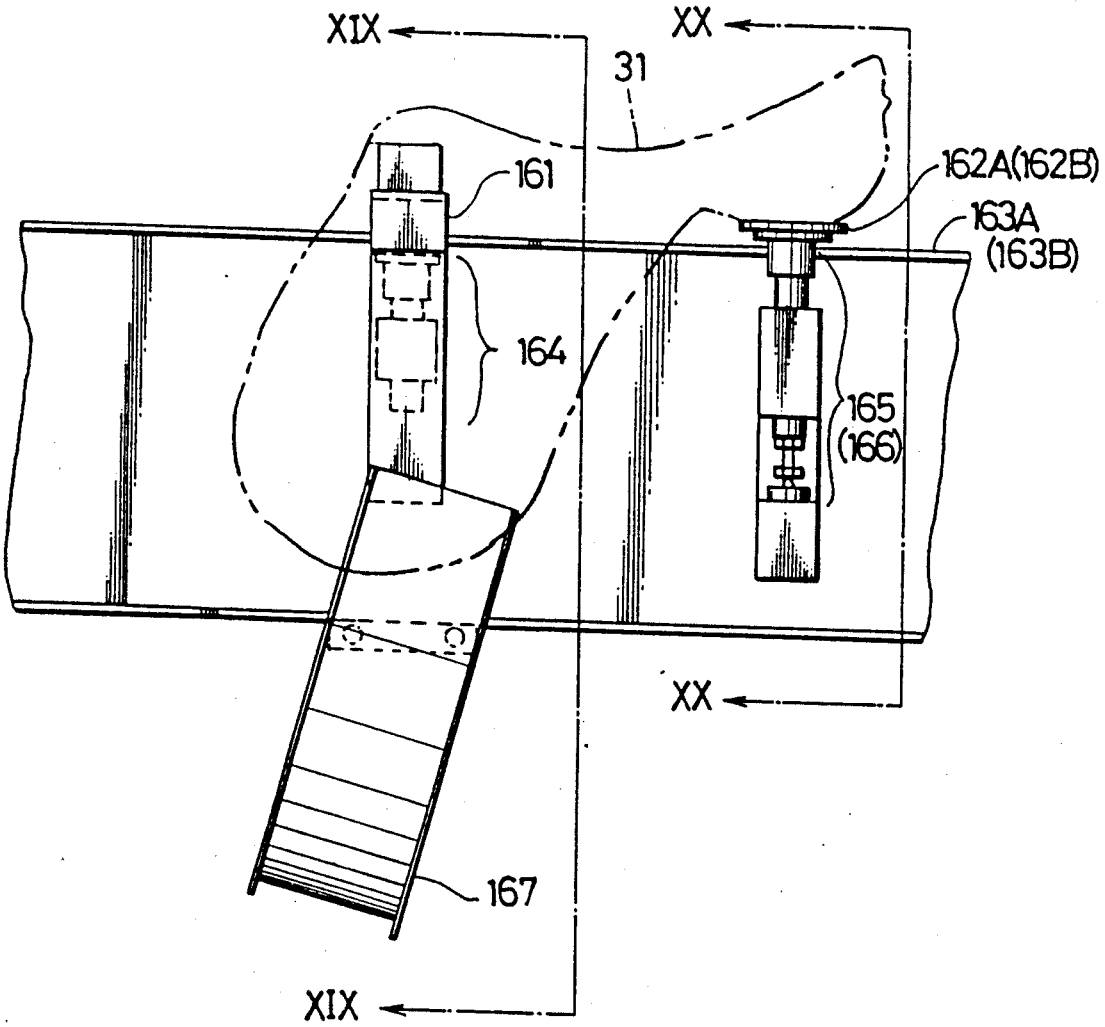
FIG. 18 is a side view of the saddle structure.
Figure 19:
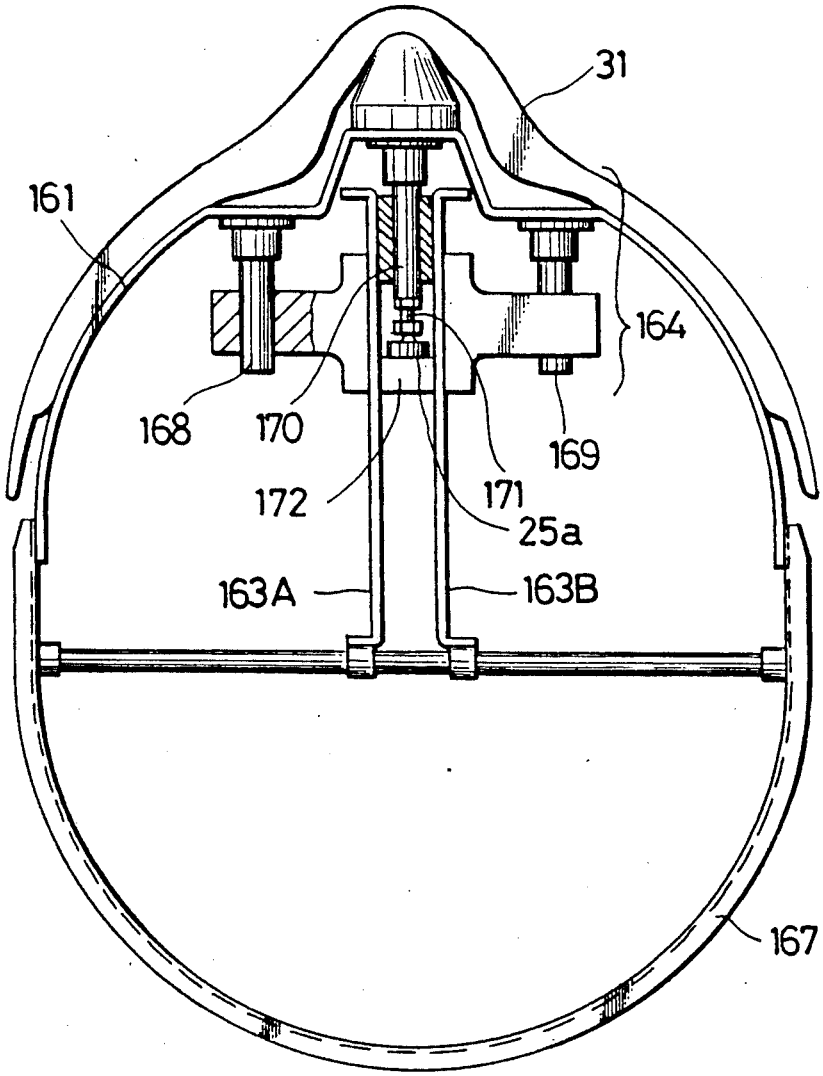
FIG. 19 is a vertical sectional view taken in the direction of the arrows along the line XIX—XIX of FIG. 18.
Figure 20:
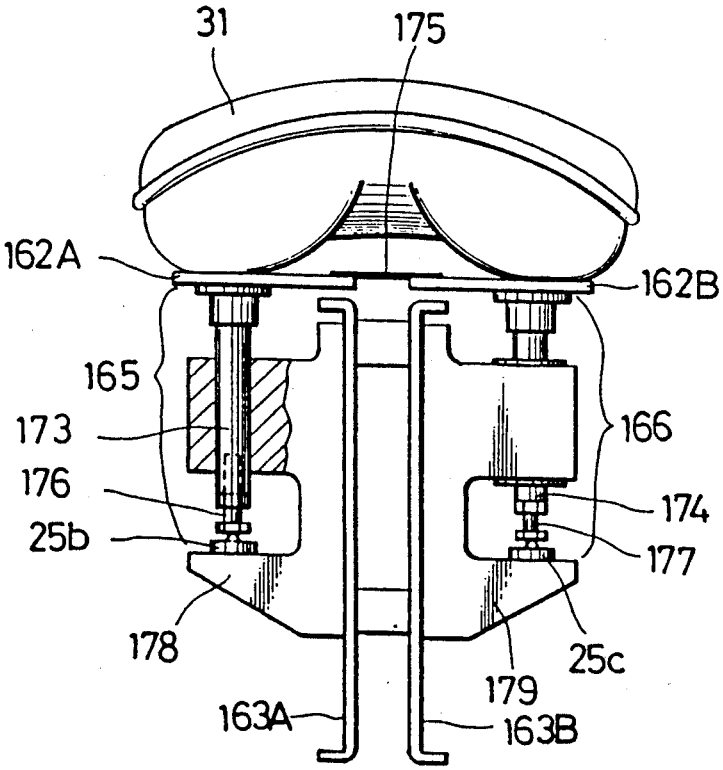
FIG. 20 is an end view taken in the direction of arrows along the lines XX—X of FIG. 18.

Referring next to FIGS. 18 to 20, a description will be given as to the mechanism for supporting the saddle 31, and for transmitting saddle loading to the saddle load sensors 25*a*, 25*b* and 25*c* and sensing the saddle loading.

As shown in FIG. 18, the saddle 31 placed on the back of the horse body 2 is supported individually at three points of a front saddle support device 164 attached to a pair of backbone plates 163A and 163B of the horse body 2 through a back plate 161 in the form similar to the contour of the back of a real horse, and a pair of rear saddle support devices 165 and 166 disposed symmetrically with respect to the backbone plates 163A and 163B through a pair of back plates 162A and 162B. The front saddle support device 164 and the rear saddle support devices 165 and 166 are so constructed as to move freely in only vertical direction. In order to prevent falling of the saddle 31 from the back of the horse body 2 during movement thereof, a saddle girth (not shown) similar to the one for a real horse is used to fix the saddle 31 to a saddle girth support 167 connected to the backbone plates 163A and 163B.

As shown in FIG. 19, the front saddle support device 164 includes three guide rods 168, 169 and 170 each of which has only a vertical freedom so as to correctly transmit loading applied vertically through the saddle 31 to the saddle load sensor 25*a*. The left and right guide rods 168 and 169 are operative to make null the inclination in the left and right directions. The central guide rod 170 is provided at the lower portion thereof with a load aJjusting device 171 for adjusting the length of the guide rod 170 and thereby the load applied thereto. Under the load adjusting device 171 of the central guide rod 170 is provided a load sensor support 172 held tightly between the backbone plates 163A and 163B, and the saddle load sensor 25*a* is mounted on the upper surface of the load sensor support 172. Thus, vertical loading applied to the front portion of the saddle 31 can be detected by the saddle load sensor 25*a* through the hack plate 161.

FIG. 20 shows the rear saddle support devices 165 and 166 in detail. A pair of vertical guide rods 173 and 174 are mounted symmetrically with respect to the backbone plates 163A and 163B on the the back plates 162A and 162B, respectively. These guide rods 173 and 174 are operative to move freely in only vertical direction. A distortion buffer device 175 is provided between the back plates 162A and 162B so as to absorb the distortion in a transverse direction to prevent relative interference between the guide rods 173 and 174. The guide rod 173 is provided at the lower portion thereof with a load adjusting device 176 constructed in the same way as the load adjusting device 171 and is adapted for adjusting the length of the guide rod 173 and thereby the load applied thereto. The guide rod 174 is also provided at the lower portion thereof with a load adjusting device 177 similar to the above load adjusting device 176. Under these load adjusting devices 176 and 177 are provided load sensor supports 178 and 179 which are fixed to the backbone plates 163A and 163B so as to carry the saddle load sensors 25*b* and 25*c* thereon, respectively. Thus, vertical loading applied to the rear portion of the saddle 31 can be detected by the saddle load sensors 25*b* and 25*c* through the back plates 162A and 162B.

With this saddle load detecting arrangement, as periodic loading in the vertical direction including the rider is applied to the saddle load sensors 25*a*, 25*b* and 25*c* in accordance with the number of swing at which the horse body 2 is driven, the loading is detected by the saddle load sensors 25*a*, 25*b* and 25*c*, and electric signals outputted therefrom are inputted to the control unit 18.

Now, the rein control detecting device will be described with reference to FIGS. 21, 22, 23 and 24.

Figure 21:
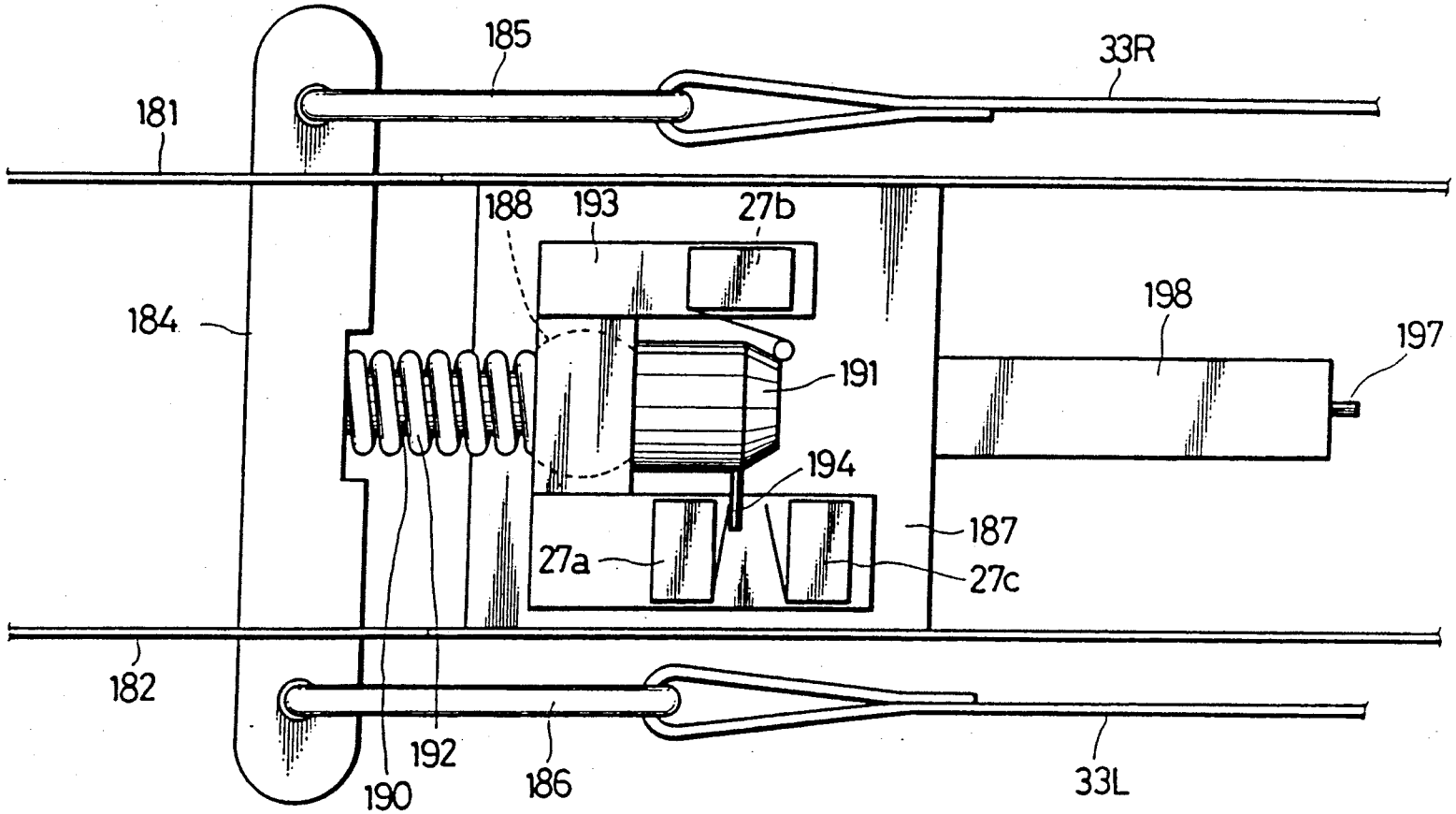
FIG. 21 is a plan view of the rein control detecting device.
Figure 22:
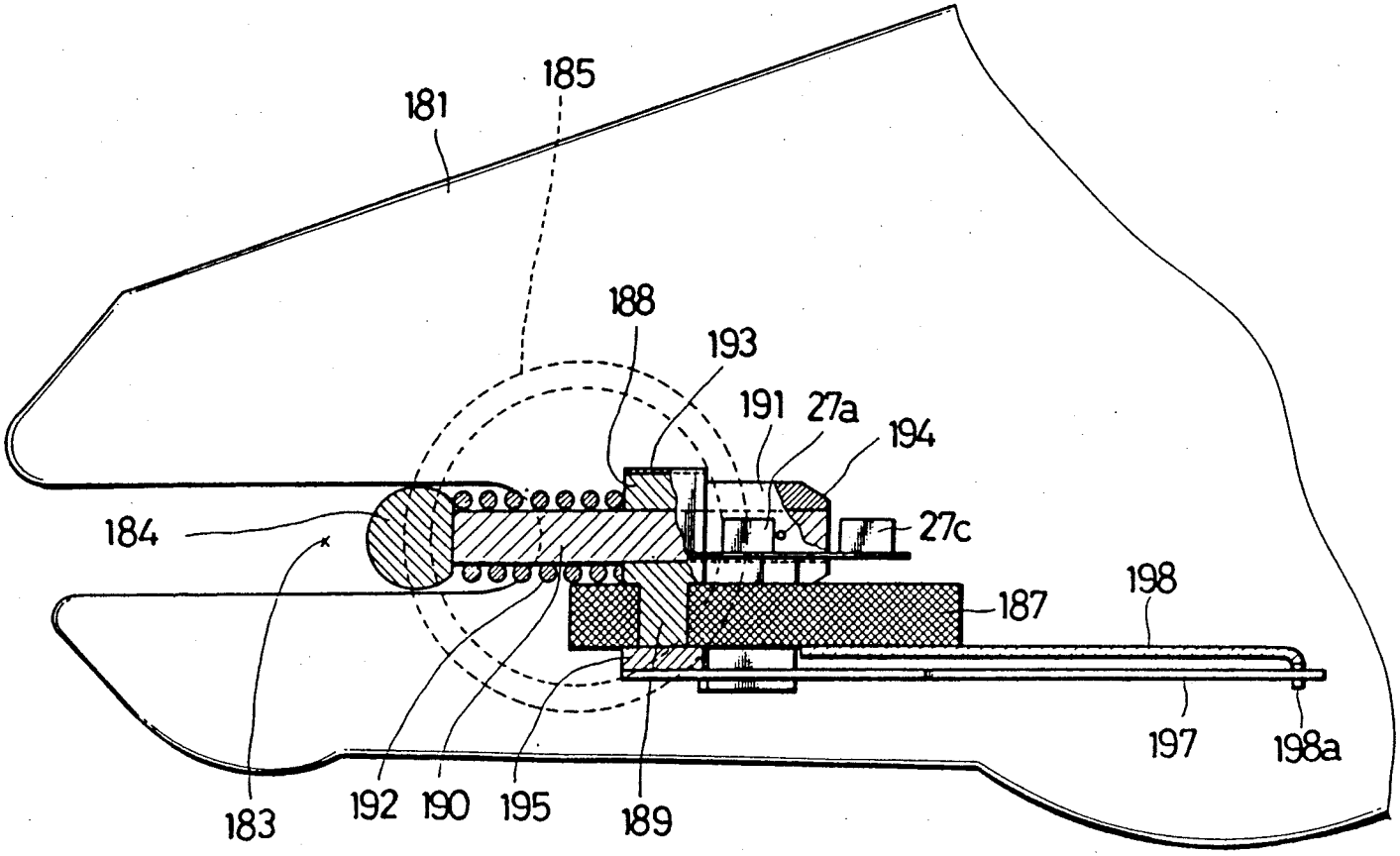
FIG. 22 is a side view of the rein control detecting device.

As shown in FIGS. 21 and 22, a pair of head plates 181 and 182 in the same form after the head of a real horse are provided, each having a mouth portion 183, and a rod-like bit 184 extends horizontally in and between the mouth portions 183, having opposite ends through which rings 185 and 186 are fitted, respectively. The rings 185 and 186 are connected with ends of right and left rein portions 33R and 33L which have the other ends tied to each other by a buckle (not shown) or the like to form the single rein 33 as shown in FIG. 2. A thick plate-like base 187 is disposed horizontally between the head plates 181 and 182. A cylindrical pivot 188 is vertically attached to the base 187, with a shank portion 189 thereof being rotatably received in the base 187. Thus, the pivot 188 is supported by the base 187 for pivotal movement about the shank portion 189.

A shaft 190 is attached to the central portion of the bit 184, horizontally extending therefrom at right angles thereto. The shaft 190 extends slidably through the pivot 188 and has a portion extending outwardly beyond the pivot 188 on which a sleeve 191 is fitted. The shaft 190 is encircled by a spring 192 having one end attached to the bit 184 and the other end attached to the pivot 188 to be held therebetween in a compressed manner. Therefore, the spring 192 normally imparts such an urging force as to displace the bit 184 apart from the pivot 188, and when the rein portions 33R and 33L are synchronously drawn by the rider 1, the bit 184 can be displaced toward the pivot 188 against the urging force of the spring 192. The sleeve 191 serves as a stopper for displacement of the bit 184 in the forward direction of the horse body 2 caused by the urging force of the spring 192.

Figure 24:
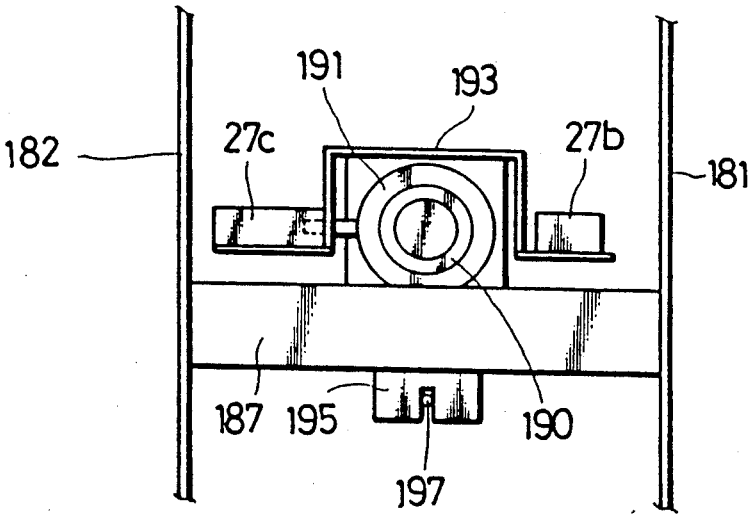
FIG. 24 is a detailed view of a portion of the rein control detecting device.

A bracket 193 having a convex portion as shown in FIG 24 is mounted on the upper end face of the pivot 188, and the sensors 27*a*, 27*b* and 27*c* of the type of limit switches are positionally adjustably carried on the bracket 193, as shown in FIG. 21. The sleeve 191 is provided with a pin 194 projecting outwardly at right angles to the axis of the sleeve 191 so as to serve as a striker for the sensors 27*a* and 27*c*. The outer peripheral surface of the sleeve 191 serves as a striker for the sensor 27*b*.

With this arrangement, when both of the rein portions 33R and 33L are in a released condition, the end face of the sleeve 191 is in abutment against the pivot 188, and the bit 184 is displaced in its foremost position. At this time, the pin 194 of the sleeve 191 is in contact with the sensor 27*a*, which outputs a signal to the control unit 18, so that the control unit 18 may detect the released condition of the rein portions 33R and 33L. When the rider 1 draws both of the rein portions 33R and 33L synchronously by a moderate force, the shaft 190 is slightly slided rearward, so that the pin 194 is moved apart from the sensing area of the sensor 27*a*. As this occurs, output of the signal from the sensor 27*a* is stopped, so that the control unit 18 may control the horse body 2 to cause a movement, for example, of the steady speed. Thereafter, when both of the rein portions 33R and 33 are synchronously drawn more strongly, the sensor 27*b* is actuated by the sleeve 191 to output a signal to the control unit 18, so that the control unit 18 may detect the more strongly drawn condition of the rein portions 33R and 33L. When receiving this signal, the control unit 18 controls the movement of the horse body 2 to be, for example, decelerated. When both of the rein portions 33R and 33L are synchronously drawn further more strongly than in the above decelerating control, the pin 194 is brought into contact with the sensor 27*c*, so that the sensor 27*c* is operated to output a signal to the control unit 18. When receiving this signal, the control unit 18 controls the movement of the horse body 2 into a braked condition.

When the rider 1 again releases the rein portions 33R and 33L, the urging force of the spring 192 causes the bit 184 to be displaced to its foremost position, with the sleeve 191 being brought into abutment against the pivot 188 to serve as the stopper.

As the sensor bracket 193 is fixed to the pivot 188, rotation of the pivot 188 causes no change in the positional relationship of the sensors 27*a*, 27*b* and 27*c* relative to the sleeve 191 and the pin 194, and only the linear movement in the longitudinal direction caused by the shaft 190 is effective.

Figure 23:
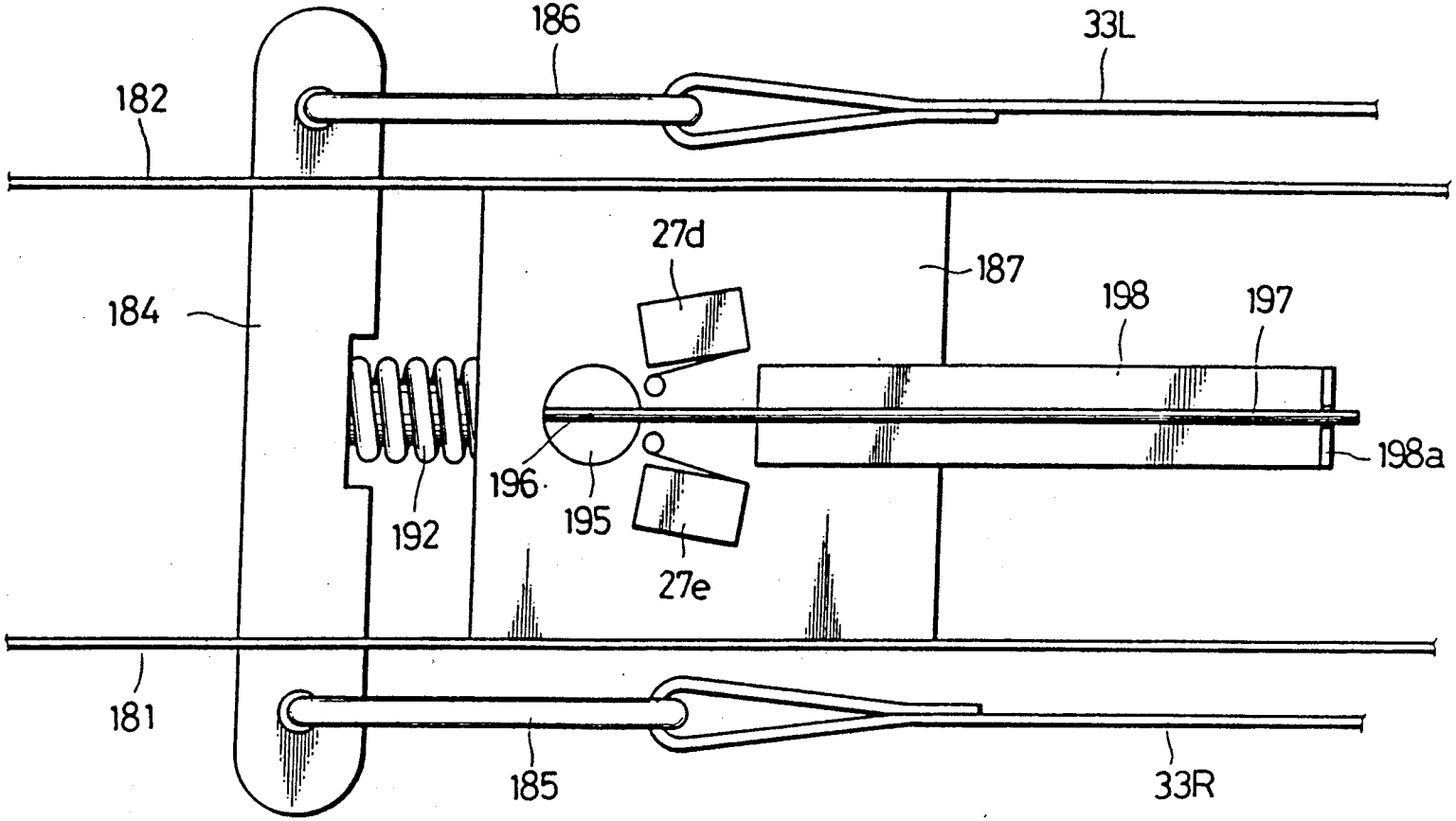
FIG. 23 is a bottom view of the rein control detecting device.

As shown in FIGS. 22, 23 and 24, a disc 195 having an appropriate thickness is attached to the lower end face of the pivot 188 fitted in the base 187. The disc 195 has in the bottom surface thereof a groove 196 extending longitudinally of the horse body 2. A linear spring 197 has one end fixedly fitted in the groove 196. A spring holder 198 for holding the other end of the spring 196 is fixed to the bottom surface of the base 187. The spring holder 198 has a distal end 198*a* bend downwardly at right angles, and the other end of the spring 197 is fixed to the bent portion 198*a*. When both of the rein portions 33R and 33L are in the released condition, the spring 197 is operative to impart an urging force for holding the pivot 188 at a predetermined angular position, i.e. for keeping the bit 184 in its neutral position with no pivotal motion in the right or left direction.

When either one of the rein portions 33R and 33L is operated to turn the pivot 188 and consequently the spring 197 is deflected, the deflected portion of the spring 197 is brought into contact with limit switch-type sensors 27*d* and 27*e* which are positionally adjustably mounted on the bottom surface of the base 187.

With this arrangement, when either one of the rein portions 33R and 33L is operated to impart a rein control force to the bit 184, the pivot 188 is turned in either of the right and left directions, and consequently the disc 195 is also turned, causing deflection of the spring 197, while, when both of the rein portions 33R and 33L are in the released condition, the urging force of the spring 197 causes the pivot 188 to be held in a predetermined neutral position.

In the above arrangement, if the rein portion 33R is strongly drawn, the pivot 188 is turned clockwise against the urging force of the spring 197, which causes deflection of the spring 197, and the deflected portion thereof is brought into contact with the sensor 27*d*, so that the sensor 27*d* is operated to output a signal to the control unit 18. The control unit 18 receives this signal and thereby detects the drawn condition of the rein portion 33R to calculate the level of the riding technique of the rider by the riding technique evaluation system which will be mentioned later. Similarly, when the other rein portion 33L is strongly drawn, the pivot 188 is turned counterclockwise against the urging force of the spring 197, which causes deflection of the spring 197, and the deflected portion thereof is brought into contact with the sensor 27*e*, so that the sensor 27*e* is operated to output a signal to the control unit 18, which detects the drawn condition of the rein portion 33L. When the rein portions 33R and 33L are released, the urging force of the spring 197 causes the pivot 188 to return to the neutral position.

As the sensors 27*a*, 27*b* and 27*c* are positionally adjustable, they can be located at positions suitable to the rein control force of the rider 1.

Figure 25:
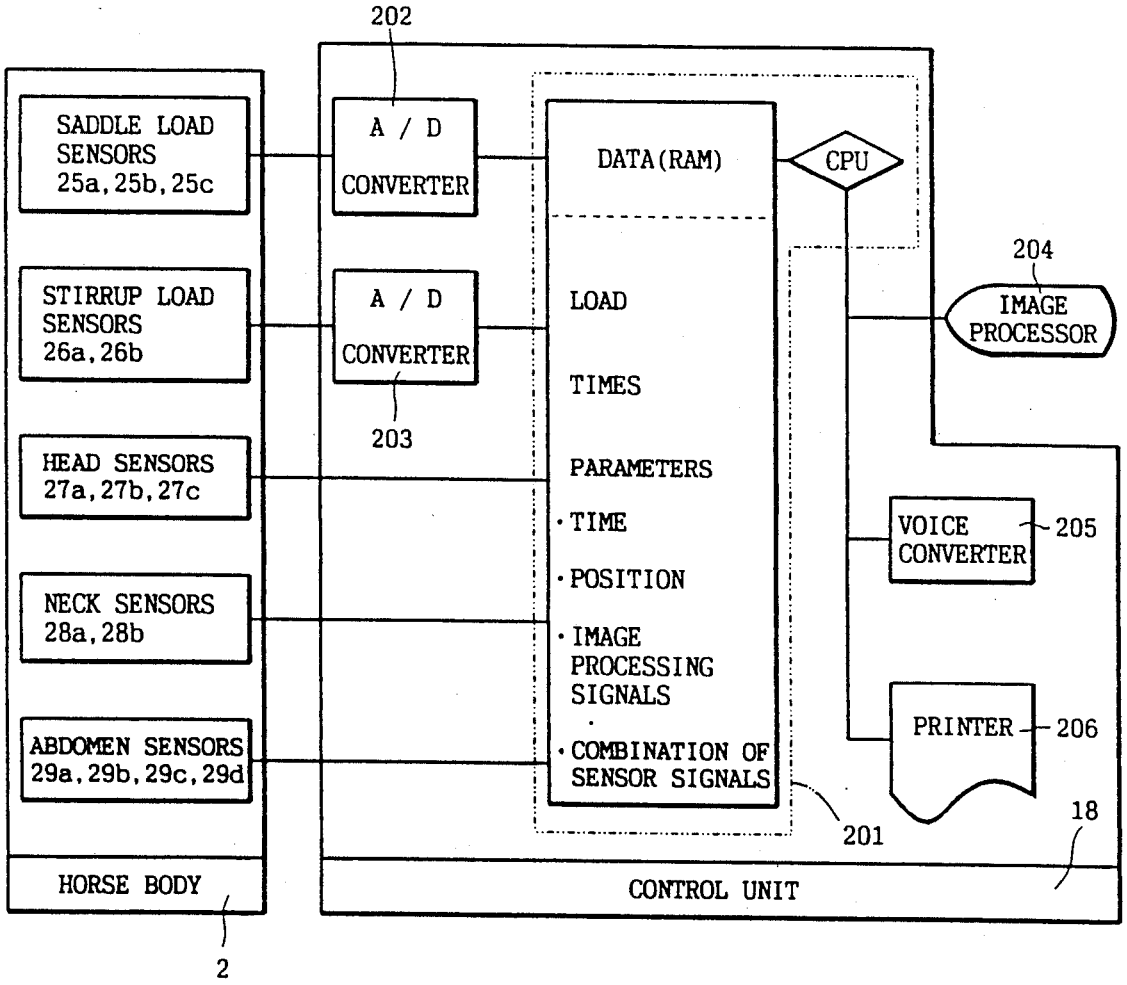
FIG. 25 is a block diagram illustrating the control system of the riding simulator.

FIG. 25 is a system block of the training system for riding. As described above, the saddle load sensors 25*a*, 25*b* and 25*c* detect the load of the saddle 31, weight of the rider 1 and loading caused by shift of the weight of the rider 1 and output detection signals in response to the detected load and loading. These signals are analog signals and must be converted into digital signals so as to be accepted in a microcomputer 201 for evaluating the level of the riding technique of the rider 1. Therefore, the saddle load sensors 25*a*, 25*b* and 25*c* are connected through an A/D converter 202 with the microcomputer 201.

The stirrup load sensors 26*a* and 26*b* for detecting load applied by the legs of the rider 1 also output analog detection signals, so that the stirrup load sensors 26*a* and 26*b* are connected through an A/D converter 203 with the microcomputer 201.

As the head sensors 27*a*, 27*b*, 27*c*, 27*d* and 27*e* output digital detection signals, they can be directly connected with the microcomputer 201. The neck sensors 28*a* and 28*b* and the abdomen sensors 29*a*, 29*b*, 29*c* and 29*d* also output digital detection signals, they are directly connected with the microcomputer 201.

The microcomputer 201 includes a RAM for storing various data and a CPU for inputting detection signals from the various sensors and calculating and evaluating the level of the riding technique of the rider 1 in accordance with the signals. The CPU is connected with a display unit, for example, an image processor 204 such as CRT, a voice converter 205 and a printer 206 to display the evaluated level of the riding technique of the rider 1.

Now, the operation of the training system for riding will be described with reference to FIG. 26.

Figure 26:
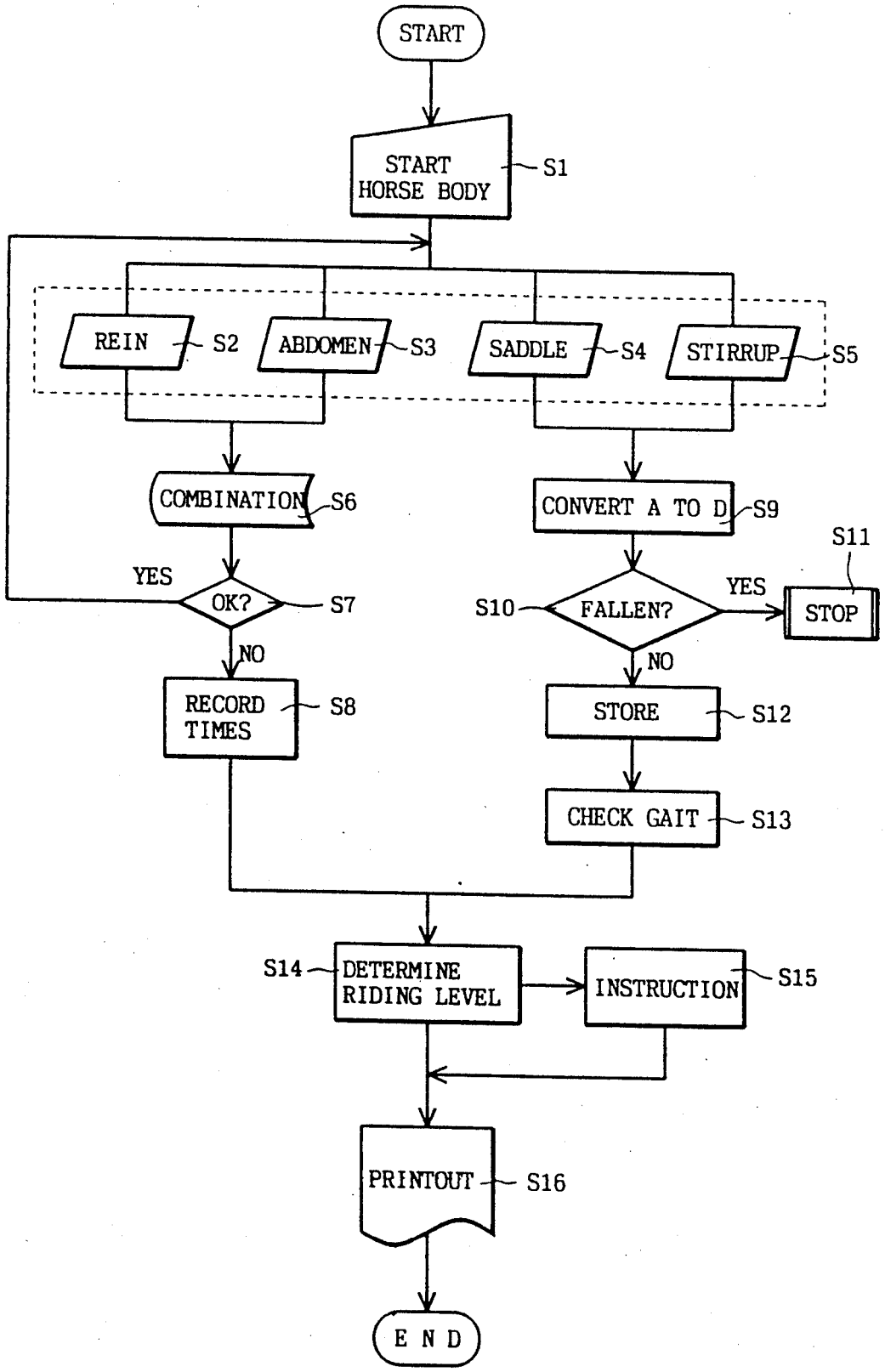
FIG. 26 is a flow chart illustrating the evaluation system of the riding technique.

Before the riding technique level calculating flow chart in FIG. 26 is started, a composite value of the output signals from the saddle load sensors 25*a*, 25*b* and 25*c* without a rider 1 on the saddle 31 is stored in the RAM, and thus, the dead weight of the saddle 31 is recognized.

In step S1 of the riding technique level calculating flow chart, the gait of the horse body 2 is set, for example, to walk through a setting switch of the control panel 22. Then, the rider 1 seats on the saddle 31, with his feet resting on the right and left stirrups 32. In this condition, when the rider 1 gives an aid through his legs, the control unit 18 outputs a driving command signal corresponding to walk to the inverter 17 to start the horse body 2. In step S2, when the rein 33 is operated, detection signals from the head sensors 27*a*, 27*b*, 27*c*, 27*d* an 27*e* and detection signals from the neck sensors 28*a* and 28*b* outputted in response to the operation of the rein 33 are inputted. In step S3, detection signals from the abdomen sensors 29*a*, 29*b*, 29*c* and 29*d* outputted in response to the aid given to the horse body 2 by the legs of the rider 1 are inputted. In step S4, load of the saddle 31, weight of the rider 1 and loading caused by shift of the weight of the rider 1 are detected, and detection signals outputted from the saddle load sensors 25*a*, 25*b* and 25*c* in response to the detected load and detected loading are inputted. In step S5, load applied by the legs of the rider 1 is detected, and detection signals outputted from the stirrup load sensors 26*a* and 26*b* in response to the detected load inputted.

In step S6, the detection signals outputted from the head sensors 27*a*, 27*b*, 27*c*, 27*d* and 27*e* and the detection signals outputted from the neck sensors 28*a* and 28*b* in response to the operation of the rein and the detection signals from the abdomen sensors 29*a*, 29*b*, 29*c* and 29*d* are combined, and data about combination of the respective aids for starting, acceleration, deceleration and stopping of the horse body 2 given by rein operation and aids by the legs of the rider 1 are processed, and in step S7, the program determines whether the aid is properly carried out or not. If the determination in step S7 is "NO", the aid is improper, and the count of the improper aids is recorded in step S8.

In step S9, the detectioa signals from the saddle load sensors 25*a*, 25*b* and 25*c* and the detection signals from the stirrup load sensors 26*a* and 26*b* are converted by the A/D converter 202 and 203 into the digital signals, which are stored in the RAM at a time interval less than 1 Hz. At this time, the detection signals from the above sensors are combined and the time of day is stored.

In step S10, the detection signals from the saddle load sensors 25*a*, 25*b* and 25*c* are monitored at the time interval less than 1 Hz, and if input of the detection signals is continuously less than the composite value over a predetermined period of time, it is decided that the rider 1 has fallen or got off the horse body 2, and in step S11, supply of driving power from the control unit 18 to the inverter 17 is stopped. If the detection signals from the saddle load sensors 25*a*, 25*b* and 25*c* and the detection signals from the stirrup load sensors 26*a* and 26*b* are continuously inputted, the detection signals are stored in the RAM in step S12. In step S13, data about combinations of the respective aids for starting, acceleration, deceleration, turning and stopping of the horse body 2 given by loading of the rider 1 through the saddle 31 and the stirrups 32 are processed to check the gait when the aids are given.

In step S14, the level of the riding technique of the rider 1 is operated in accordance with the data recorded in step S8 and the data about the gait checked in step S13 to calculate the marks. In step S15, data about instruction of the riding technique corresponding to the level of the riding technique of the rider 1 or the like is called, and in step S16, the calculated marks and the data about the instruction are printed out. These data may be a barometer of the training level to be used by the rider 1 and an instructor for the rider 1.

Figure 27:
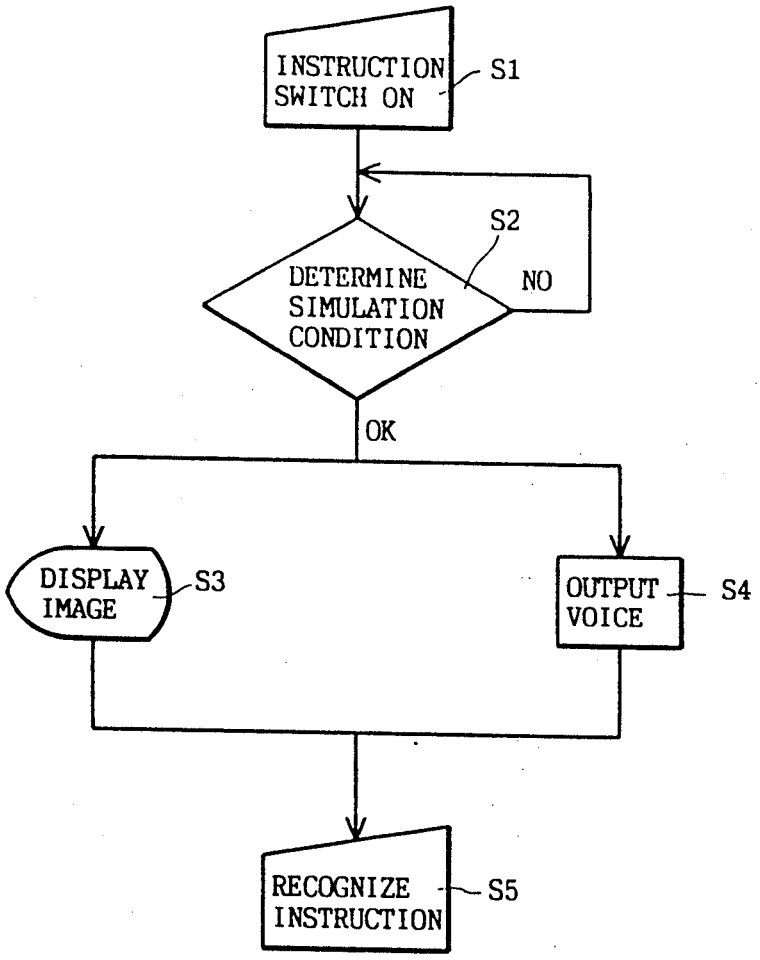
FIG. 27 is a flow chart of the instruction of the riding technique.

FIG. 27 shows a flow chart for enabling the rider 1 to learn proper aids to be given to a real horse. The proper aids are obtained in accordance with the basic motions of the horse body 2, and are indicated by images or voices, if desired by the rider 1 or the instructor.

When, in step S1 in FIG. 27, an instruction switch provided, for example, on the horse body 2 or on the control panel 22 is depressed by the rider 1 or the instructor, the microcomputer 201 determines in step S2 whether the horse body 2 is driven in the set action mode or not. If the determination is "OK", proper aids to be given to a real horse in accordance with the driving condition of the horse body 2 is transmitted to the rider 1 through the display means such as the image processor 204 in step S3 or the speaker means such as the voice converter 205 in step S4. In step S5, the rider 1 or the instructor recognizes the transmitted proper aids to be given to a real horse in accordance with the driving condition of the horse body 2.

As described above, in accordance with the present invention, control of the number and length of swing and the phase of the horse body in association with various gaits enables the horse body to closely simulate the movement of a real horse, and the rider can give aids for starting, change of gaits, and stopping. Therefore, the riding simulator system has the following effects:

(1) The present invention can be applied to a riding training machine which is safe in use and which permits effective and efficient acquirement of the riding techniques. In the riding simulator of the present invention, as the horse body is completely free from unexpected dangerous actions, basic riding techniques can be acquired safely. Furthermore, as a certain action associated with the technique to be acquired can be accurately repeated, correct riding techniques can be achieved in a shorter period of time.

(2) The present invention can be applied to a riding machine for amusement in an amusement park or the like which may provide quite comfortable riding feeling.

(3) The present invention can be applied to a riding machine for fitness which may give comfortable riding feeling to the user and which may increase consumption of calories of the user by causing hard movement such as canter of the horse body.

While the invention has been described with reference to a preferred embodiment thereof, it is to be understood that modifications or variations may be easily made without departing from the spirit of this invention which is defined by the appended claims.

What is claimed is:

1. A riding simulator comprising:

an artificial horse body including a barrel on which a rider can ride for simulating the riding of a real horse, a neck pivotally mounted on the top front end of said barrel, a head pivotally mounted on said neck and having a rein attached thereto, a saddle mounted on a top of said barrel and having stirrups attached thereto, a right and a left foreleg pivotally mounted on the bottom front end of said barrel, and a right and a left hind leg pivotally mounted on the bottom rear end of said barrel;

first horse body supporting structures for circularly movably supporting the lower ends of the right and left forelegs of said horse body and for pivotally supporting the coupling points of the upper ends of the right and left forelegs with the barrel of said horse body;

second horse body supporting structures for circularly movably supporting the lower ends of the right and left hind legs of said horse body with the same ends held in a horizontal plane and for pivotally supporting the coupling points of the upper ends of the right and left hind legs with the barrel of said horse body;

swing adjusting devices for driving said first and second horse body supporting structures and for moving said horse body in both vertical and longitudinal directions such that the swing of said horse body is adjustable in both vertical and longitudinal directions;

phase adjusting devices for adjusting the phase difference between the vertical motion and the longitudinal motion of said horse body when said first and second horse body supporting structures are driven to move said horse body in vertical and longitudinal directions;

drive force transmitting mechanisms for transmitting drive force to said swing adjusting devices through said phase adjusting devices;

main motors for outputting the drive force to said drive force transmitting mechanisms;

a control unit for supplying drive power to said main motors for adjusting the rotational speed of said main motors and for outputting electric power to said phase adjusting devices for adjusting the phase of said phase adjusting devices; and means for setting modes of stepping motions corresponding to a plurality of basic stepping motions of said horse body based on the swing produced by said swing adjusting devices, the phase difference produced by said phase adjusting devices and the rotational speed of said main motors, and for outputting setting signals indicative of the set modes to said control unit.

2. The riding simulator as defined in claim 1 further comprising:

saddle load sensors for detecting a load when the rider rides on said saddle of said horse body and for outputting a detection signal indicative of the load;

stirrup load sensors for detecting a load of the leg of the rider applied to said stirrups of said saddle and for outputting a detection signal indicative of the load;

head sensors for detecting a direction and strength when said rein attached to said head of said horse body is pulled and for outputting a detection signal indicative of the direction and strength;

neck sensors for detecting a force applied to said neck which is passively movable when said rein is pulled and for outputting a detection signal indicative of the force;

abdomen sensors attached to the abdomen of said horse body for detecting aids given by the legs of the rider on said saddle and for outputting a detection signal indicative of the aids;

riding technique level calculating means for receiving the detection signals outputted from said saddle load sensors, stirrup load sensors, head sensors, neck sensors and abdomen sensors, respectively, for calculating riding technique level of said rider, and for outputting data indicative of the calculated level; and indicating means for receiving the data of said riding technique level calculated by said riding technique level calculating means and for indicating the calculated level.

3. The riding simulator as defined in claim 1 wherein each of said first horse body supporting structures comprises:

foreleg supporting means for circularly movably supporting the respective ones of the lower ends of the right and left forelegs of said horse body; and coupling means for pivotally coupling the respective ones of the upper ends of the right and left forelegs to the barrel of said horse body through a distortion-absorbing member.

4. The riding simulator as defined in claim 1 wherein each of said second horse body supporting structures comprises:

hind leg supporting means for circularly movably supporting the respective ones of the lower ends of the right and left hind legs of said horse body;

a linkage for circularly moving said hind leg supporting means with the respective ones of the lower ends of said right and left hind legs held in said horizontal plane; and coupling means for pivotally coupling the respective ones of the upper ends of the right and left hind legs to the barrel of said horse body through a distortion-absorbing member.

5. The riding simulator as defined in claim 1 wherein each of said swing adjusting devices comprises:

a main driving shaft rotatable by an external drive motor;

a guide case rotatable in response to rotation of said main driving shaft;

an eccentric shaft positionally adjustably mounted on said guide case at a position radially eccentric from the center of rotation of said guide case and for pivotally supporting the respective ones of the lower ends of the right and left forelegs and hind legs; and means for eccentrically moving said eccentric shaft in a radial direction of said guide case.

6. The riding simulator as defined in claim 1 wherein each of said phase adjusting devices comprises:

a driving shaft rotatable by the rotational force of said main motor;

a driving gear mounted on said driving shaft;

a driven shaft for rotating said swing adjusting device:

a driven gear mounted on said driven shaft;

intermediate gears engageable with said driving gear and said driven gear for rotation on their common axis and for revolution around the axis of said driving gear and said driven gear;

a support structure for rotatably supporting said intermediate gears;

a phase producing mechanism for rotating said support structure and for producing a relative rotational angle difference between said driving shaft and said driven shaft; and a rotational angle sensor for detecting a rotational angle of said support structure rotated by said phase producing mechanism and for outputting a detection signal indicative of the rotational angle of said support structure to said control means.

* * * * *

UNITED STATES PATENT AND TRADEMARK OFFICE

CERTIFICATE OF CORRECTION

PATENT NO. : 4,988,300

DATED : January 29, 1991

INVENTOR(S) : Yamaguchi et al

It is certified that error appears in the above-identified patent and that said Letters Patent is hereby corrected as shown below:

Column 22, line 13, "control means" should read -- control unit --.

Signed and Sealed this

Fourteenth Day of July, 1992

*Attest:*

DOUGLAS B. COMER

*Attesting Officer*

*Acting Commissioner of Patents and Trademarks*